US009842730B2

(12) United States Patent
Schoen et al.

(10) Patent No.: US 9,842,730 B2
(45) Date of Patent: Dec. 12, 2017

(54) METHODS FOR TANDEM COLLISION-INDUCED DISSOCIATION CELLS

(71) Applicant: Thermo Finnigan LLC, San Jose, CA (US)

(72) Inventors: Alan E. Schoen, Kilauea, HI (US); Harald Oser, San Carlos, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/963,123

(22) Filed: Dec. 8, 2015

(65) Prior Publication Data

US 2017/0162371 A1 Jun. 8, 2017

(51) Int. Cl.
*H01J 49/00* (2006.01)
*H01J 49/42* (2006.01)

(52) U.S. Cl.
CPC ..... *H01J 49/005* (2013.01); *H01J 49/0031* (2013.01); *H01J 49/421* (2013.01)

(58) Field of Classification Search
USPC ..... 250/282
See application file for complete search history.

(56) References Cited

U.S. PATENT DOCUMENTS 4,214,160 A 7/1980 Fies et al.
5,625,184 A * 4/1997 Vestal ..... H01J 49/403 250/282
5,847,386 A 12/1998 Thomson et al.
6,163,032 A 12/2000 Rockwood
6,259,088 B1 7/2001 Antesberger
6,316,768 B1 11/2001 Rockwood et al.
6,417,511 B1 7/2002 Russ, IV et al.
6,713,757 B2 3/2004 Tanner et al.
(Continued)

FOREIGN PATENT DOCUMENTS

WO 2014/197341 A2 12/2014

OTHER PUBLICATIONS

Andrews, et al., "Performance Characteristics of a New Hybrid Triple Quadrupole Time-of-Flight Tandem Mass Spectrometer", Anal. Chem. 2011, 83, pp. 5442-5446.
(Continued)

*Primary Examiner* — Phillip A Johnston
(74) *Attorney, Agent, or Firm* — Thomas F. Cooney

(57) ABSTRACT

A method for operating a mass spectrometer so as to detect or quantify analytes, comprises: (a) identifying a selected-reaction-monitoring (SRM) transition to be used for each respective analyte; (b) determining a time duration required for a fragmentation reaction corresponding to each identified transition to proceed to a threshold percentage of completion; and (c) for each analyte, performing the steps of (i) isolating ions corresponding to a precursor-ion mass-to-charge (m/z) ratio of the respective transition; (ii) fragmenting the respective isolated ions in one of two fragmentation cells or fragmentation cell portions; and (ii) mass analyzing for fragment ions corresponding to a product-ion m/z ratio of the respective transition, wherein, for each analyte, the fragmentation cell or fragmentation cell portion that is used for fragmenting the isolated ions is determined from the time duration determined for the respective analyte.

19 Claims, 16 Drawing Sheets

(56) References Cited

U.S. PATENT DOCUMENTS

| | | | | |
|---|---|---|---|---|
| 6,753,523 | B1 | 6/2004 | Whitehouse et al. | |
| 6,800,846 | B2 | 10/2004 | Bateman et al. | |
| 6,949,743 | B1 * | 9/2005 | Schwartz | H01J 49/0063 250/290 |
| 7,034,292 | B1 * | 4/2006 | Whitehouse | H01J 49/004 250/281 |
| 7,064,322 | B2 | 6/2006 | Crawford et al. | |
| 7,067,802 | B1 | 6/2006 | Kovtoun | |
| 7,385,185 | B2 * | 6/2008 | Dowell | H01J 49/0072 250/281 |
| 7,564,025 | B2 | 7/2009 | Crawford | |
| 7,595,486 | B2 | 9/2009 | Franzen | |
| 7,675,031 | B2 * | 3/2010 | Konicek | H01J 49/4225 250/281 |
| 7,985,951 | B2 | 7/2011 | Okumura et al. | |
| 8,294,088 | B2 * | 10/2012 | Pringle | H01J 49/025 250/283 |
| 2007/0138383 | A1 | 6/2007 | Dowell et al. | |
| 2011/0049360 | A1 | 3/2011 | Schoen | |
| 2011/0121175 | A1 | 5/2011 | Yasuno et al. | |
| 2015/0136966 | A1 | 5/2015 | Badiei et al. | |
| 2015/0340212 | A1 | 11/2015 | Ueda | |

OTHER PUBLICATIONS

Gillet, et al., "Targeted Data Extraction of the MS/MS Spectra Generated by Data-independent Acquisition: A New Concept for Consistent and Accurate Proteome Analysis", Molecular & Cellular Proteomics 11.6, 2012, pp. 1-17.

* cited by examiner

METHODS FOR TANDEM COLLISION-INDUCED DISSOCIATION CELLS

FIELD OF THE INVENTION

This invention relates generally to mass spectrometry and mass spectrometers and, in particular, to methods and apparatus for conducting multiple selected reaction monitoring procedures so as to analyze for the presence of and, optionally, the quantity of, each of a plurality of analytes.

BACKGROUND OF THE INVENTION

The constant evolution of analytical instrumentation consists in achieving faster data acquisition and improved instrument sensitivity. In the field of mass spectrometry, structural elucidation of ionized molecules is often carried out using a tandem mass spectrometer, where a particular precursor ion is selected at the first stage of analysis or in the first mass analyzer (MS-1), the precursor ions are subjected to fragmentation (e.g. in a collision cell), and the resulting fragment (product) ions are transported for analysis in the second stage or second mass analyzer (MS-2). The method can be extended to provide fragmentation of a selected fragment, and so on, with analysis of the resulting fragments for each generation. This is typically referred to as $MS^n$ spectrometry, with n indicating the number of steps of mass analysis and the number of generations of ions. Accordingly, $MS^2$ corresponds to two stages of mass analysis with two generations of ions analyzed (precursor and products). As but one non-limiting example, tandem mass spectrometry is frequently employed to determine peptide amino acid sequences in biological samples. This information can then be used to identify peptides and proteins.

The procedure of performing tandem mass spectrometry so as to identify a particular analyte is sometimes referred to as selected reaction monitoring (SRM). The act of observing the presence of a particular fragment ion (of a certain product-ion mass-to-charge ratio, m/z) that is generated by fragmentation of a particular chosen and isolated precursor ion (of a certain pre-determined precursor-ion m/z) is, in many instances, powerful evidence of the presence of a particular analyte. The generation of a particular product ion by fragmentation of a selected precursor ion is often referred to as an SRM "transition". For samples that represent complex mixtures of analytes, each SRM experiment may correspond to an analysis for the presence of and, optionally, the quantity of a particular respective analyte.

A relatively new analysis technique, known as "SWATH MS" has been described for proteome analysis by Gillet et al. (Gillet et al., 2012, Targeted Data Extraction of the MS/MS Spectra Generated by Data-independent Acquisition: A New Concept for Consistent and Accurate Proteome Analysis, Mol. Cell Proteomics 11(6):O111.016717. DOI: 10.1074/mcp.O111.016717.). In the SWATH MS technique, fragment ion spectra are obtained during repeated cycling through sever consecutive precursor isolation windows (swaths). For example, Gillet et al. describe using 32 such precursor isolation windows, each such window 25 Da wide. Such SWATH MS acquisition setup generates, in a single sample injection, time-resolved fragment ion spectra for all the analytes detectable within precursor-ion range m/z range and a user-defined retention time window. The SWATH MS technique also employs a novel data analysis strategy that fundamentally differs from earlier database search approaches. Although Gillet et al. originally described SWATH MS experiments performed using a quadrupole-quadrupole time-of-flight (QqTOF) mass spectrometer system, this data analysis technique may also be employed on a triple-quadrupole mass spectrometer system as illustrated in FIG. 1A described below.

FIG. 1A depicts the components of a conventional mass spectrometer system 1 that may be employed for tandem mass spectrometry. It will be understood that certain features and configurations of the mass spectrometer system 1 are presented by way of illustrative examples, and should not be construed as limiting the implementation of the present teachings in or to a specific environment. An ion source, which may take the form of an electrospray ion source 5, generates ions from an analyte material supplied from a sample inlet. For example, the sample inlet may be an outlet end of a chromatographic column, such as liquid or gas chromatograph (not depicted), from which an eluate is supplied to the ion source. The ions are transported from ion source chamber 10 that, for an electrospray source, will typically be held at or near atmospheric pressure, through several intermediate chambers 20, 25 and 30 of successively lower pressure, to a vacuum chamber 35. The high vacuum chamber 35 houses a quadrupole mass filter (QMF) 51, an ion reaction cell 52 (such as a collision or fragmentation cell) and a mass analyzer 40. Efficient transport of ions from ion source 5 to the vacuum chamber 35 is facilitated by a number of ion optic components, including quadrupole radio-frequency (RF) ion guides 45 and 50, octopole RF ion guide 55, skimmer 60, and electrostatic lenses 65 and 70. Ions may be transported between ion source chamber 10 and first intermediate chamber 20 through an ion transfer tube 75 that is heated to evaporate residual solvent and break up solvent-analyte clusters. Intermediate chambers 20, 25 and 30 and high-vacuum chamber 35 are evacuated by a suitable arrangement of pumps to maintain the pressures therein at the desired values. In one example, intermediate chamber 20 communicates with a port of a mechanical pump (not depicted), and intermediate pressure chambers 25 and 30 and high-vacuum chamber 35 communicate with corresponding ports of a multistage, multiport turbomolecular pump (also not depicted).

Electrodes 80 and 85 (which may take the form of conventional plate lenses) positioned axially outward from the mass analyzer 40 may be used in the generation of a potential well for axial confinement of ions, and also to effect controlled gating of ions into the interior volume of the mass analyzer 40. The mass analyzer 40, which may comprise a quadrupole ion trap, a quadrupole mass filter, a time-of-flight analyzer, a magnetic sector mass analyzer, an electrostatic trap, or any other form of mass analyzer, is provided with at least one detector 49 that generates a signal representative of the abundance of ions that exit the mass analyzer. If the mass analyzer 40 is provided as a quadrupole mass filter, then a detector at detector position as shown in FIG. 1A will generally be employed so as to receive and detect those ions which selectively completely pass through the mass analyzer 40 from an entrance end to an exit end. If, alternatively, the mass analyzer 40 is provided as a linear ion trap or other form of mass analyzer, then one or more detectors at alternative detector positions may be employed.

Ions enter an inlet end of the mass analyzer 40 as a continuous or quasi-continuous beam after first passing, in the illustrated conventional apparatus, through a quadrupole mass filter (QMF) 51 and an ion reaction cell 52. The QMF 51 may take the form of a conventional multipole structure operable to selectively transmit ions within an m/z range determined by the applied RF and DC voltages. The reaction cell 52 may also be constructed as a conventional multipole structure to which an RF voltage is applied to provide radial confinement. The reaction cell may be employed, in conventional fashion, as a collision cell for fragmentation of ions. In such operation, the interior of the cell 52 is pressurized with a suitable collision gas, and the kinetic energies of ions entering the collision cell 52 may be regulated by adjusting DC offset voltages applied to QMF 51, collision cell 52 and lens 53.

The mass spectrometer system 1 shown in FIG. 1A may operate as a conventional triple quadrupole mass spectrometer, wherein ions are selectively transmitted by QMF 51, fragmented in the ion reaction cell 52 (employed as a collision cell), and wherein the resultant product ions are mass analyzed so as to generate a product-ion mass spectrum by mass analyzer 40 and detector 49. Samples may be analyzed using standard techniques employed in triple quadrupole mass spectrometry, such as precursor ion scanning, product ion scanning, single- or multiple reaction monitoring, and neutral loss monitoring, by applying (either in a fixed or temporally scanned manner) appropriately tuned RF and DC voltages to QMF 51 and mass analyzer 40. The operation of the various components of the mass spectrometer systems may be directed by a controller or a control and data system 15, which will typically consist of a combination of general-purpose and specialized processors, application-specific circuitry, and software and firmware instructions. The control and data system 15 may also provide data acquisition and post-acquisition data processing services.

FIG. 1B is a more-detailed depiction of the ion reaction cell 52 showing an entrance electrode 53 disposed at an entrance end 58*a* of the device and an exit electrode 80 disposed at an exit end 58*b*. As illustrated, the ion reaction cell comprises a radio-frequency (RF) multipole device—specifically, in this example, a quadrupole—comprising four elongated and substantially parallel rod electrodes arranged as a pair of first rod electrodes 61 and a pair of second rod electrodes 62. The leftmost diagram of FIG. 1B provides a longitudinal view and the rightmost diagram provides a transverse cross-sectional view, respectively, of the ion reaction cell 52. Note that only one of the rod electrodes 62 is shown, since the view of the second rod electrode 62 is blocked in the depicted view. The four rod electrodes define an axis 59 of the device that is, parallel to the rod electrodes 62, 61 and that is centrally located between the rod electrodes; in other words, the four rod electrodes 62, 61 are equidistantly radially disposed about the axis 59.

Although the reaction cell 52 shown in FIG. 1B is illustrated with straight, parallel rod electrodes, alternative reaction cell configurations are known in which the electrodes are curved. Although the reaction cell 52 is shown with four rods so as to generate an RF quadrupolar electric field, the reaction cell may alternatively comprise six (6) rods, eight (8) rods, or even more rods so as to generate a hexapolar, octopolar, or higher-order electric field respectively. The rod electrodes may be contained within a housing 57 which serves to contain a collision gas used for collision induced dissociation of precursor ions introduced into a trapping volume 12 between the rod electrodes 62, 61 through an entrance end 58*a*.

FIG. 1C schematically illustrates typical basic electrical connections for the rod electrodes 62, 61. RF modulated potentials provided by power supply 250 are applied to points A and B, which are electrically connected to electrodes 62 and electrodes 61, respectively. The electrode of each pair of electrodes—that is, the pair of electrodes 62 and the pair of electrodes 61—are diametrically opposed to one another with respect to the ion occupation volume 12 that surrounds the longitudinal axis 59. The phase of the RF voltage applied to one of the pairs of electrodes is exactly out of phase with the phase applied to the other pair of electrodes.

In known fashion, application of RF potentials to the rod electrodes 62, 61 as discussed above produces an electric field pseudo-potential well about and in close proximity to the central axis 59. In operation, ion lenses or electrodes, including entrance electrode 53, exit electrode 80 and possibly others (not shown in FIG. 1C) are used to propel ions into the entrance end 58*a* (FIG. 1B) of the multipolar rod set (e.g., rod electrodes 62, 61) defined by a set of first ends of the plurality of rods. The presence of the RF-generated pseudo-potential well causes the ions to remain in an ion trapping volume in the vicinity of the axis 59 as these ions progress through the reaction cell from the entrance end 58*a* to an exit end 58*b* of the multipolar rod set.

The ion trapping volume does not have sharp boundaries that can be precisely located. In any event, however, the true trapping volume lies approximately within the region 12 denoted by lines connecting the innermost points of the four rod electrodes. Thus the region 12 can be considered to comprise a practical trapping volume that is defined by the electrodes themselves such that the true trapping volume resides within the practical trapping volume 12. Both the practical trapping volume and the true trapping volume are elongated parallel to the axis 59 between the entrance end 58*a* and the exit end 58*b*. The entrance and exit ends 58*a*, 58*b* are defined by the ends of the rod electrodes 62, 61. The ion trapping produced by the application of the RF field is effective in directions that are radial to the axis 59 (that, is within transverse cross-sectional planes such as the one illustrated on the right-hand side of FIG. 1B). In some instances, ions may be temporarily trapped along the dimension parallel to or along the axis 59.

In some instances, the elevated collision gas pressure within a collision cell can cause product ions that have been formed in the collision cell to drain out of the cell slowly or possibly even stall within the collision cell as a result of their very low velocity after many collisions with neutral gas molecules. The resulting lengthened ion clear-out time can cause experimental difficulties when several ion pairs (i.e., parent/products) are being measured in rapid succession. U.S. Pat. No. 5,847,386, in the names of inventors Thomson et al., describes several apparatus configurations that are designed to reduce this problem through the provision of an electric field that is parallel to the device axis within the space between the elongated electrodes.

Another apparatus configuration described in the aforementioned U.S. Pat. No. 5,847,386 includes segmented rods, wherein different DC offset voltages are applied between adjacent segments such that ions within the interior volume experience a stepped DC electrical potential in a direction from the entrance end to the exit end. For example, FIG. 1D illustrates a collision cell or reaction cell 152 in which the rods 62 and the rods 61 (as shown in and previously described in reference to FIG. 1B) are replaced by series of rod segments 161 and 162, respectively. Each of the segments 161 is supplied with the same RF voltage and each segments 162 is supplied with the same phase-shifted RF voltage from power supply 250 via a set of isolating capacitors (not illustrated), but each is supplied with a different DC voltage.

U.S. Pat. No. 7,675,031, in the names of inventors Konicek et al. and assigned to the assignee of the present invention, describes an alternative apparatus configuration to address the problem of slowed ion movement through a collision cell. Konicek et al. teaches the use of auxiliary electrodes for creating drag fields within the cell interior volume. The auxiliary electrodes may be provided as arrays of finger electrodes for insertion between main RF electrodes (e.g., the rod electrodes 62, 61 shown in FIG. 1B) of a multipole device. The finger electrodes may be provided on thin substrate material such as printed circuit board material. A progressive range of voltages can be applied along lengths of the auxiliary electrodes by implementing a voltage divider that utilizes static resisters interconnecting individual finger electrodes of the arrays. Dynamic voltage variations may be applied to individual finger electrodes or to groups of the finger electrodes.

FIG. 1E shows a simplified depiction of one exemplary configuration taught in U.S. Pat. No. 7,675,031. The leftmost view of FIG. 1E is a longitudinal view of the apparatus 252 showing, very schematically, the disposition of auxiliary electrodes 54*a*-54*d*, which may be configured with one or more terminal finger electrodes, between the main rod electrodes 62, 61, wherein these rod electrodes are as shown in FIG. 1B. The rightmost view of FIG. 1E is a transverse cross-sectional view which more accurately show how the auxiliary electrodes 54*a*-54*d* are disposed between adjacent pairs of the main rod electrodes. The auxiliary electrodes can occupy positions that generally define planes that, if extended, intersect on the central axis 59. These planes can be positioned between adjacent RF rod electrodes at about equal distances from the main RF electrodes of the multipole ion guide device where the quadrupolar fields are substantially zero or close to zero, for example. Thus, the configured arrays of finger electrodes 71 can lie generally in these planes of zero potential or close to zero potential so as to minimize interference with the quadrupolar fields. The array of auxiliary electrodes and finger electrodes can also be adapted for use with curved quadrupolar configurations such as the configuration shown in FIG. 1D.

FIG. 2A illustrates a simplified depiction of one exemplary configuration taught in U.S. Pat. No. 7,675,031. The configuration includes auxiliary electrodes 54*a*, 54*b*, 54*c*, 54*d* that are configured with one or more finger electrodes 71 and that are designed to be disposed between adjacent pairs of main rod electrodes 61, 62. The relative positioning of the main rod electrodes 61, 62 and auxiliary electrodes 54*a*, 54*b*, 54*c*, 54*d* in FIG. 2A is somewhat exploded for improved illustration. The auxiliary electrodes can occupy positions that generally define planes whose extensions intersect on the central axis 59, as shown by the directional arrow as referenced by the Roman Numeral III and as also shown in FIG. 1E. These planes can be positioned between adjacent RF rod electrodes 61, 62 at about equal distances from the main RF electrodes of the electrode set where the quadrupolar fields are substantially zero or close to zero, for example. Thus, the configured arrays of finger electrodes 71 can lie generally in these planes of zero potential or close to zero potential so as to minimize interference with the quadrupolar fields. The right-hand side of FIG. 1E shows and end view perspective of the configuration of FIG. 2A, illustrating how the radial inner edges 64*a*, 64*b*, 64*c*, and 64*d* (see also FIG. 2A) of the finger electrodes 71 may be positioned relative to the main rod electrodes 61 and 62.

Turning back to FIG. 2A, each electrode of the array of finger electrodes 71 may be connected to an adjacent finger electrode 71 by a predetermined resistive element 74 (e.g., a resistor) and in some instances, a predetermined capacitor 77. The desired resistors 74 set up respective voltage dividers along lengths of the auxiliary electrodes 54*a*, 54*b*, 54*c*, 54*d*. The resultant voltages on the array of finger electrodes 71 thus form a range of voltages, often a range of step-wise monotonic voltages. The voltages create a voltage gradient parallel to the axis 59 that urges ions through the reaction cell 52 from the entrance end 58*a* to the exit end 58*b*. In the examples shown in FIGS. 2A-2B, the voltages applied to the auxiliary electrodes often comprise static voltages, and the resistors often comprise static resistive elements. The capacitors 77 reduce an RF voltage coupling effect in which the RF voltages applied to the main RF rod electrodes 61, 62 typically couple to and heat the auxiliary electrodes 54*a*, 54*b*, 54*c*, 54*d* during operation of the RF rod electrodes 61, 62.

In an alternative configuration taught in U.S. Pat. No. 7,675,031 and as shown in FIG. 2B, one or more of the auxiliary electrodes can be provided by an auxiliary electrode array, as shown generally designated by the reference numeral 130, which has dynamic voltages individually applied to one or more of the array of finger electrodes 71. In this alternative configuration, the controller 15 may include or be augmented by computer controlled voltage supplies 83, 84, 85, which may take the form of Digital-to-Analogue Converters (DACs). There may be as many of these computer controlled voltage supplies 83, 84, 85 as there are finger electrodes 71 in an array, and that each computer controlled voltage supply may be connected to and control a voltage of a respective finger electrode 71 for the array.

As shown in FIG. 2B, and as briefly discussed above, the auxiliary electrode 130, may as one arrangement, have designed voltages applied by a combination of dynamic computer controlled voltage supplies 83, 84, 85 and voltage dividers in the form of static resistors 74 so as to form an overall monotonically progressive range of voltages along a length of a multipole device. In such a configuration, the magnitude and range of voltages may be adjusted and changed to meet the needs of a particular sample or set of target ions to be analyzed. As also shown in FIG. 2B, capacitors 77 may be connected between adjacent finger electrodes 71.

FIG. 2B also shows in detail, the configuration of a radially inner edge 88 that is similar to the radially inner edges 64*a*, 64*b*, 64*c*, 64*d*, described above for FIG. 2A. The radially inner edge 88 includes a central portion 91 that may be metalized or otherwise provided with a conductive material, tapered portions 92 that straddle the central portion 91, and a recessed gap portion 93. The central portions 91 may be metalized in a manner that connects metallization on both the front and the back of the auxiliary electrode array 130 for each of the finger electrodes 71 of the array of finger electrodes. As an innermost extent of the auxiliary electrode 130, the central portion 91 presents the DC electrical potential in close proximity to the ion path. Gaps 96 including recessed gap portions 93 are needed between metallization of the finger electrodes 71 in order to provide an electrical barrier between respective finger electrodes.

A structural element for receiving and supporting metallization may be a substrate 99, as shown in FIG. 2B, of any printed circuit board (PCB) material, such as, but not limited to, fiberglass, that can be formed, bent, cut, or otherwise shaped to any desired configuration so as to be integrated into the working embodiments of the present invention. Although FIG. 2B shows the substrate as being substantially flat and having straight edges, it is to be understood that the substrates and the arrays of finger electrodes thereon may be shaped with curved edges and/or rounded surfaces. Substrates that are shaped and metalized in this way are relatively easy to manufacture. Thus, auxiliary electrodes in accordance with embodiments of the present invention may be configured for placement between curved main rod electrodes of curved multipoles.

Other Known Methods/Apparatus for Generating Axial or Drag Fields in a Collision Cell Reference is next made to FIGS. 8A-8D, which show a known modified quadrupole rod set 700 which is modified according to the teachings provided in U.S. Pat. No. 5,847,386 in the names of inventors Thomson et al. The quadrupole rod set 700 comprises a first pair of rods consisting of rods 701 and a second pair of rods consisting of rods 708, both sets of rods equally tapered. The rods 701 of one pair are oriented so that the wide ends 702 of the rods are at the entrance 703 to the interior volume of the rod set, and the narrow ends 704 are at the exit end 705 of the rod set. The rods 708 of the other pair are oriented so that their wide ends 709 are at the exit end 705 of the interior volume and so that their narrow ends 710 are at the entrance 703. The rods define a central longitudinal axis 707.

Each of the rods of 701 and the rods 708 are electrically connected together, with an RF potential applied to each pair (through isolation capacitors C2) by an RF generator 711. A separate DC voltage is applied to each pair, e.g. voltage V1 to the rods 701 and voltage V2 to the rods 708, by DC voltage sources 712*a* and 712*b*. The supplied DC voltages provide an axial potential (i.e. a potential on the axis 707) which is different at one end from that at the other end. Thus, an axial field is created along the axis 707. Although a quadrupole rod set is illustrated, the general principles of operation of the modified rod set 700 may be applied to multipole rod sets comprising more than four rods.

FIG. 9 is a side view of two rods of another known rod set configuration 720 as taught in the aforementioned U.S. Pat. No. 5,847,386 and that may be employed to generate an axial field along a central axis 727 of the rod set. The rods are of the rod set 720 are all the same diameter but are oriented such that, at an entrance end 723 of the apparatus, the ends 726 of a first pair of rods, comprising rods 721, are located closer to the central axis 727 than are the opposite ends 724 of the rods 721. In other words, the rods 721 diverge away from the central axis 727 in a direction from the entrance end 723 to the exit end 725 of the quadrupole apparatus. A second pair of rods, comprising rods 728, are oriented such that, at the entrance end 723, the ends 722 are further from the central axis 727 than are the opposite ends 724 of those same rods. Thus, the rods 728 of the second pair converge towards the axis 727 in a direction from the entrance end 723 to the exit end 725. Note that, as in all the other accompanying drawings, the illustration of the rod set 720 is not drawn to scale and thus sizes and angles are exaggerated for clarity.

An alternative non-parallel multipole rod configuration has been described in U.S. Pat. No. 7,985,951 in the name of inventors Okumura et al. and in U.S. Patent Publication No. 2011/0049360 in the name of inventor Schoen. In the above-described rod set 720 (FIG. 9), one set of rods diverges away from a central axis in a direction from an entrance end to an exit end and the other rod set converges towards the central axis in the same direction. In contrast, in the RF-only multipole apparatuses (not illustrated herein) taught in U.S. Pat. No. 7,985,951 and U.S. Publ. No. 2011/0049360, the surfaces of all rods diverge away from the central axis in the direction from the entrance to the exit end. The divergence of the rod surfaces away from the central axis may alternatively be described as an increase in an inscribed radius, $r_0$ (the radius of a circle lying in a radial plane of the multipole that is tangent to the rod inner surfaces), in the same direction. The increase of the inscribed radius, $r_0$, may be most simply accomplished by tilting the long axes of a set of right-circular cylindrical rods such the rod axes diverge from the apparatus central axis in the direction from the entrance to the exit end. The increase of the inscribed radius may also be accomplished by tapering the rods. The divergence of the rod surfaces away from the central axis in the direction of ion travel produces a pseudo-potential gradient that urges ions towards the exit end of the multipole device. This effect may increase the rate at which ions are transported through the multipole device and prevent stalling and unintended trapping of ions. Moreover, by increasing $r_0$ from the inlet end to the exit end of an RF multipole, the value of the Mathieu parameter q of an ion is progressively reduced in the direction of ion travel, resulting in a reduced effective low-mass cutoff and the availability of greater numbers of low-m/z fragment ions for mass analysis.

Similar to the electrical connections shown in FIG. 8B, the rods of 721 of the first rod pair are electrically connected together and the rods of the other (not-illustrated) pair are connected together, with an RF potential applied to each pair by an RF generator. A separate DC voltage is applied to each pair. The supplied DC voltages provide an axial potential (i.e. a potential on the axis 727) which is different at one end from that at the other end. Although a quadrupole rod set is illustrated, the general principles of operation of the modified rod set 720 may be applied to multipole rod sets comprising more than four rods.

FIG. 10 is an end view of a known quadrupole apparatus 730 comprising a set of auxiliary rods or electrodes as taught in the aforementioned U.S. Pat. No. 5,847,386. The four small auxiliary electrodes or rods 732*a*-732*d* are mounted parallel to one another and to the quadrupole rods 731, 738 in the spaces between the quadrupole rods. Each of the auxiliary rods 732*a*-732*d* has an insulating core 733 with a surface layer of resistive material 734. A voltage applied between the two ends of each auxiliary rod causes a current to flow in the resistive layer, establishing a potential gradient from one end to the other. With all four auxiliary rods connected in parallel, i.e. with the same voltage difference between the ends of the auxiliary rods, the fields generated contribute to the electric field on the central axis 737 of the quadrupole, establishing an axial field or gradient.

FIG. 11 is a side view of another known quadrupole apparatus comprising a set of auxiliary rod electrodes as taught in the aforementioned U.S. Pat. No. 5,847,386. Although the apparatus 740 that is schematically illustrated in FIG. 11 comprises four auxiliary rods, only two such auxiliary rods 742*a*-742*b* are shown for clarity. In contrast to the orientation of the auxiliary rods 732*a*-732*d* shown in FIG. 10, in which all rods are parallel to the central axis defined by quadrupole rods, the auxiliary rods of the apparatus 740 are tilted, so that they are closer to the central axis 747, as defined by the parallel quadrupole rods 741 and 748, at one end 743 than at the other end 745 of the apparatus. Since the auxiliary rods are closer to the axis at end 743 than at end 745, the potential at end 743 is more affected by the potential on the auxiliary rods than at the other end 745. As a result, an axial potential is generated which varies uniformly from one end to the other since the auxiliary rods are straight. The potential can be made to vary in a non-linear fashion if the auxiliary rods 742*a*-742*b* are curved.

The apparatuses described above, comprising conductive rods (either tilted or tapered quadrupole rod electrodes or tilted conductive auxiliary rod electrodes) having different static DC voltages applied to respective different pairs of rods, may disadvantageously give rise to a quadrupole DC field along the central axis. The effect of such a DC field on the properties of an RF-only ion guide may be summarized as the introduction of mass discrimination, whereby the range of ionic mass-to-charge ratios ions that can be transported through a quadrupole ion guide apparatus is reduced. U.S. Pat. No. 6,163,032, in the name of inventor Rockwood, therefore taught the use ion guides in which the number of electrodes are doubled to thereby use symmetry to cancel the undesirable DC quadrupole field. An example of one such apparatus taught in U.S. Pat. No. 6,163,032 is illustrated herewith as FIG. 12.

The modified quadrupole system 750 schematically illustrated in FIG. 12 has twice the number of electrodes 751 than a standard quadrupole system. In the illustrated embodiment, the quadrupole electrode pairs 752 taper in opposite directions. One electrode 751 of the electrode pair 752 tapers from its widest cross section beginning at an arbitrarily selected first end 753 of the system 750 down to its narrowest cross section ending at a second end 755 of the system 750. The other electrode 751 of the electrode pair 752 tapers in the opposite direction and has its narrowest cross section at the first end 753 and widens out to its widest cross section at the second end 755 of the system.

Each electrode 751 of the electrode pair 752 has applied thereto a radio frequency (RF) voltage and a direct current (DC) voltage. Both electrodes 751 of an electrode pair 752 have a same RF voltage applied thereto. However, while electrodes 751 within a same electrode pair have the same polarity, adjacent electrode pairs 752 have applied thereto RF voltages which are always opposite in polarity.

In contrast, DC voltages are applied in order to generate an axial DC electrical field. In order to create an electrical potential between the first end 753 and the second end 755, one electrode 751 of each pair 752 always has a first DC voltage applied thereto, whereas the other electrode of the electrode pair always has a second applied DC voltage. All electrodes 751 having a same cross section width at the first end have the same DC voltage applied thereto in order to generate the axial DC field gradient required to accelerate ions.

FIGS. 13A and 13B schematically illustrate a side view and a cross sectional view of a single rod of a quadrupole or multipole rod set that is modified so as to enable generation of an axial field according to a further teaching of the aforementioned U.S. Pat. No. 5,847,386. Rod 760 is formed as an insulating ceramic tube 762 having on its exterior surface a pair of end metal bands 764 which are highly conductive. Bands 764 are separated by an exterior resistive outer surface coating 766. The inside of tube 762 is coated with conductive metal 768. The wall of tube 762 is relatively thin, e.g. about 0.5 mm to 1.0 mm.

In operation of a multipole apparatus comprising rods 760, a DC voltage difference indicated by V1 is connected to the resistive surface 176 by the two metal bands 174, while the RF from a power supply is connected to the interior conductive metal surface 178. The high resistivity of outer surface 176 restricts the electrons in the outer surface from responding to the RF (which is at a frequency of about 1.0 MHz), and therefore the RF is able to pass through the resistive surface with little attenuation. At the same time voltage source VI establishes a DC gradient along the length of the rod 170, again establishing an axial DC field.

The inventors, Crawford et al., of U.S. Pat. No. 7,064,322 considered that multipole devices that use high resistance multipole rods may be prone to the phenomenon "RF droop" (i.e., areas of reduced RF). The inventors considered that this phenomenon may cause ions to become stalled (and/or filtered) as they are transported through such an ion guide. To counteract this disadvantageous property, the U.S. Pat. No. 7,064,322 teaches the use, in multipole devices, of rods exemplified by the schematic illustration in FIG. 14 herein, wherein each of the rods of the multipole device may be described as containing an inner conductive element 778, an outer resistive element 774, and an insulative element 776 between the inner element 778 and outer element 774. The elements are coaxially arranged along the length of each rod to provide a rod that can be thought of as a coaxial capacitor containing a resistive outer coating. The inner element 778 may optionally be centrally located in the rod (as shown in the uppermost rod of FIG. 14) or optionally present as a layer upon a central core 772 of the rod that provides structural strength (as shown in the lowermost rod of FIG. 14). According to the teachings of U.S. Pat. No. 7,064,322, the insulation and resistive layers do not need to go all the way around the rod, but can be limited to the surface of the rod which influences the ion beam.

FIG. 14 also illustrates exemplary electrical connections between a pair of quadrupole rods 771, such as a pair of rods diametrically opposed to one another across a central axis, according to the teachings of U.S. Pat. No. 7,064,322. In the illustrated embodiment, the resistive element 774 and the conductive element 778 of a rod are electrically connected with each other at one end of the rod. Resistive elements 774 and conductive elements 778 of each of the rods of the rod pair are connected at the same end to the same DC voltage source 773 and the same RF source 775. Likewise, the resistive elements and conductive elements of each of the rods of the other pair of rods (not illustrated in FIG. 14) are connected at the same end to the DC voltage source 773 and the same RF source 775. Resistive element 774 and not conductive element 778 of each rod is connected to DC voltage source 779 and RF source 777 at the other end of each rod. The DC voltage sources 773 and 779 typically supply different DC voltages to the ends of the rods, thereby providing a voltage gradient along the rod. The RF voltage supplied to the ends of each one of the pair of rods 771 by RF sources 775 and 777 is typically in phase, and the RF voltage supplied to the ends of each of the other pair of rods (not shown) by RF sources 775 and 777 is typically in phase. As is known for other multipole devices, the RF voltages supplied to the illustrated rods 771 may be 180 degrees out of phase with that supplied to the other pair of rods.

The inventor, Crawford, of U.S. Pat. No. 7,564,025 determined that a much simpler rod design could be employed in a multipole ion guide device as shown in FIG. 15, in which no conductor is required in the rods and both RF and DC voltages are applied to a resistive material. The accompanying FIG. 15 shows a schematic view of an exemplary rod 780 according to the teachings of U.S. Pat. No. 7,564,025. The rod 780, which need not be cylindrical in cross section, comprises an optional insulating core rod 782 with a resistive coating 786. The resistive coating 786 is usually of small thickness compared with the diameter of core rod 782. The resistive coating 786 need not coat the entire surface of the core rod 782. However, according to the teachings of U.S. Pat. No. 7,564,025, the surface of the rod that faces the axis of the containing multipole device should be covered by the resistive coating.

FIG. 16 is a perspective view of a known ring pole ion transport apparatus as taught in U.S. Pat. No. 6,417,511 in the name of inventor Russ I V et al. The ion transport apparatus 790 illustrated in FIG. 14 comprises a multipole portion 792 and a ring stack portion 794 and has an input end 793 for accepting analyte ions and an output end 795. The ring stack portion 794 extends inside and outside the multipole portion 792, thereby essentially overlapping the multipole portion 792.

The multipole portion 792 of the apparatus 790 comprises a plurality of rods or poles 796 that are grouped together in a spaced apart relationship. The rods 796 may be either parallel or non-parallel to the central axis 797. Further, the rods 796 may have a parallel portion and/or a nonparallel portion. The central axis 797 may be linear or nonlinear, or may have a linear portion and/or a nonlinear portion. The ring stack portion 794 comprises a plurality of rings 798 in a spaced apart stacked relationship distributed along the central axis 797. Each ring 798 of the ring stack portion 794 may comprise a thin, conductive plate. Alternatively, each ring 798 may comprise a thin, nonconductive plate with a conductive coating. Each ring has a generally centrally located inner through-hole 799 to allow passage of ions therethrough. Further, each ring 798 has a plurality of spaced apart through-holes 791, each through hole 791 being dimensioned, positioned and aligned to receive one of the plurality of rods 796 of the multipole portion 792.

In operation, a radio frequency (RF) power source (not shown) is applied to the multipole portion 792 while a direct current (DC) voltage source (not shown) is applied to the ring stack portion 794, such that a respective DC voltage difference is set up between each pair of adjacent rings. The RF power source produces an RF electromagnetic field that functions to "guide" or compress the analyte ions toward a generally centrally located longitudinal axis 797 of the ring pole ion guide 790. The analyte ions, under the influence of the RF power source, travel through the ring pole ion guide 790 in a collimated trajectory, or "beam". The DC voltage source produces an axial electric field that imparts an accelerating force to the analyte ions. The axial field essentially "pushes" the ions in the transport direction (from the input end 793 to the output end 795) along the central axis 797. Therefore, the multipole portion 792 and its associated RF power source operate in conjunction with the ring stack portion 794 and its associated DC voltage source to simultaneously guide and transport analyte ions from the input end 793 to the output end 795 of the ring pole ion guide 790.

New Requirements to Achieve Fast SRM on a Triple Quadrupole

Fast SRM on a triple quadrupole mass spectrometer such as illustrated in FIG. 1A is a relatively new design goal where the desire is to achieve 500 SRM transitions or more per second. Many presently existing collision cells a purposely designed for high sensitivity. Such designs typically require long internal path lengths and multiple collision conditions that favor complex multistep reaction pathways. Unfortunately, using such a cell that is optimized for sensitivity, the total time required from the selection of a new precursor ion with Q1 to the observation of a stable product signal from Q3 can easily exceed the 2 millisecond total time available for monitoring a specific transition. Even the addition of an axial field (e.g., by employing configurations as shown in FIGS. 1D-1E, FIGS. 2A-2B, FIGS. 8A-8D, FIGS. 9-12, FIGS. 13A-B or FIGS. 14-15) has not proven to be especially useful. Indeed, some reactions have been observed that require 50 milliseconds to reach equilibrium using a collision cell optimized for sensitivity. The operation of such cells may be made faster by employing lower collision pressures and increased RF voltages, but even under these conditions, 0.5 milliseconds may be required to achieve equilibrium.

An alternative design that favors fast reaction pathways is needed for fast SRM. Such a cell may employ a short path length, preferably with an axial field that favors facile reactions that will not require more than a few hundred microseconds to complete. Therefore, fast ion transit times will be acceptable in such shorter cells. However, these short-cell designs will not provide the highest sensitivity in cases where speed is not required. Therefore, the inventors have determined that a two-collision-cell apparatus may be advantageously employed.

SUMMARY OF THE INVENTION

To address the above-identified needs in the art, the inventors here disclose mass spectrometer designs that incorporate either multiple separate collision cells or else a single collision cell having multiple segments, wherein the mass spectrometer system has the capability of dynamically choosing the appropriate collision cell or collision cell segment that is suitable for particular experimental requirements. According to some embodiments, a first collision cell (a "long" collision cell) has a length that is greater than the length of a second collision cell (a "short" collision cell). Note that the terms "first collision cell" and "second collision cell", as used herein, are used to identify and distinguish individual collision cell components and are not intended to imply any particular spatial order, unless otherwise stated. Note also that the terms "collision cell" and "fragmentation cell" are used synonymously herein.

The short collision cell is utilized for conducting fragmentation reactions that require a short time duration to proceed to effective completion under given conditions of collision cell pressure and precursor ion kinetic energy, where "effective completion" corresponds to a certain threshold percentage of precursor ions being fragmented during the reaction. The threshold percentage that corresponds to effective completion may vary according to the requirement of each experimenter or analyst and may depend, at least in part, on whether analytes are quantified, as opposed to merely detected, as well as the quantity of analyte molecules present in a sample or the level of analytical sensitivity required. In some instances, effective completion of a fragmentation reaction may correspond to greater than 50% fragmentation of precursor ions (i.e., a threshold percentage of 50%). In other instances effective completion may correspond to greater than 60%, 67%, 70%, 75%, 80%, 90%, 95%, or 99% fragmentation of precursor ions.

The phrase "short time duration" refers to a time duration (for reaction effective completion) that is less than an experimentally specified threshold time. In some instances or for some fragmentation reactions, the threshold time may be set as long as 10 msec (e.g., ten milliseconds); in other words, in such instances, the short collision cell would be used if the fragmentation reaction proceeds to effective completion in less than 10 msec. In other instances, the threshold time may be 5 msec or 10 msec. In other instances, the threshold time may be as short as 500 μsec (microseconds), 250 μsec, or 100 μsec. The threshold time may be specified in accordance with an experimental goal of achieving a certain average rate of experimentally observed transitions per second, such as at least 250 transitions per second or, more preferably, 500 transitions per second.

References to "high pressure" or "relatively high pressure", as used herein in reference to mass spectrometer internal pressures, refer to pressures suitable for fragmentation reactions by the process of collision induced dissociation in the range of about 0.5 mtorr to about 5 mtorr. Similarly, references to a collision cell being "pressurized, as used below refer to an internal gas pressure within a collision cell in the same range—that is, about 0.5 mtorr to about 5 mtorr.

The long collision cell is utilized either for conducting fragmentation reactions that require a time duration for effective completion that is longer than or equal to the threshold time or for conducting fragmentation reactions when high-sensitivity detection of the fragments is required (i.e., when detection of fragments is required at fragment abundances below a threshold limit of detection or when quantification of fragment abundances is required at fragment abundances below a threshold limit of quantification).

According to some embodiments in accordance with the present teachings, the long collision cell is not pressurized during the course of fragmentation reactions that occur primarily within the short collision cell, and is operated, in the unpressurized state, as a simple ion transfer device either to or from the short collision cell device. During operation according to other embodiments in accordance with the present teachings, the long collision cell remains pressurized during the course of fragmentation reactions that occur primarily within the short collision cell, and precursor or product ions are transferred through the long collision cell (either to or from the short collision cell, respectively) by application of an axial or drag field within the long collision cell. According to some other embodiments in accordance with the present teachings, the short collision cell is not pressurized during the course of fragmentation reactions that occur primarily within the long collision cell, and is operated as a simple ion transfer device either to or from the long collision cell. According to yet other embodiments in accordance with the present teachings, the short collision cell remains pressurized during the course of fragmentation reactions that occur primarily within the long collision cell, and precursor or product ions are transferred through the short collision cell (either to or from the long collision cell, respectively) by application of an axial or drag field within the short collision cell.

According to other embodiments, a single collision cell may be partitioned into a plurality of separate segments, each such segment comprising its own respective gas supply, lens and voltage control. The partitioned device may be considered to be an adjustable pressure and length collision cell. Collision cells in accordance with the present teachings may employ multiple rods. However, in alternative embodiments, alternative ion-confining technologies may be employed, such as, but not limited to, stacked rings and lossy dielectric tubes.

According to a first aspect of the present teachings, there is disclosed a mass spectrometer system comprising: (a) an ion source configured to receive a sample from a sample inlet; (b) a mass filter configured to receive the ions from the ion source; (c) a mass analyzer including a detector configured to separate ions in accordance with their mass-to-charge ratios and detect the separated ions; (d) a first and a second ion fragmentation cell disposed along an ion pathway between the mass filter and the mass analyzer, the first ion fragmentation cell configured to receive ions from the mass filter, the second ion fragmentation cell configured to receive ions from the first ion fragmentation cell and to outlet ions to the mass analyzer, each fragmentation cell comprising: (d1) a set of multipole rod electrodes; (d2) a housing enclosing the set of multipole rod electrodes; and (d3) a gas inlet fluidically coupled to a source of a collision gas and to an interior of the housing; (e) at least one radio-frequency (RF) voltage source electrically coupled to the set of multipole rod electrodes of each of the first and second ion fragmentation cells; and (f) at least one direct current (DC) voltage source electrically coupled to the mass filter, wherein a length, $L_2$, of the second ion fragmentation cell is less than a length, $L_1$, of the first ion fragmentation cell.

According to a second aspect of the present teachings, there is disclosed a mass spectrometer system comprising: (a) an ion source configured to receive a sample from a sample inlet; (b) a mass filter configured to receive the ions from the ion source; (c) a mass analyzer including a detector configured to separate ions in accordance with their mass-to-charge ratios and detect the separated ions; (c) a first ion fragmentation cell configured to receive ions from the mass filter and comprising a gas inlet fluidically coupled to a source of a collision gas and to an interior of the first ion fragmentation cell; (d) a second ion fragmentation cell configured to receive ions from the first ion fragmentation cell and to outlet ions to the mass analyzer, the second ion fragmentation cell comprising: (d1) a tube comprising a resistive material; (d2) a set of multipole rod electrodes disposed exteriorly to the tube; and (d3) a gas inlet fluidically coupled to a source of a collision gas and to an interior of the tube; (e) at least one radio-frequency (RF) voltage source electrically coupled to the set of multipole rod electrodes; and (f) at least one direct current (DC) voltage source electrically coupled to the mass filter and electrically coupled to the tube so as to apply an electrical potential gradient across a length of the tube, wherein a length, $L_2$, of the second ion fragmentation cell is less than a length, $L_1$, of the first ion fragmentation cell.

According to a third aspect of the present teachings, there is disclosed a mass spectrometer system comprising: (a) an ion source configured to receive a sample from a sample inlet; (b) a mass filter configured to receive the ions from the ion source; (c) a mass analyzer including a detector configured to separate ions in accordance with their mass-to-charge ratios and detect the separated ions; (d) an ion fragmentation cell configured to receive ions from the mass filter and to outlet fragment ions to the mass analyzer, the ion fragmentation cell comprising: (d1) a set of multipole rod electrodes; (d2) a housing enclosing the set of multipole rod electrodes and comprising a housing interior, an ion inlet and an ion outlet; (d3) a set of partitions within the housing separating the housing interior into a plurality of compartments, each partition comprising an aperture disposed along an ion pathway between the ion inlet and ion outlet; and (d4) a plurality of gas inlets, each gas inlet fluidically coupled to a source of a collision gas and to a respective compartment and having a respective inlet shutoff valve; (e) at least one radio-frequency (RF) voltage source electrically coupled to the set of multipole rod electrodes; (f) at least one direct current (DC) voltage source electrically coupled to the mass filter; and (g) a controller electrically coupled to each inlet shutoff valve and each vent shutoff valve, the controller configured to independently control the pressure of collision gas within each compartment.

According to another aspect of the present teachings, a method for operating a mass spectrometer so as to detect a presence of or a quantity of each of one or more analytes of a sample is disclosed, wherein the method comprises: (a) for each of the one or more analytes, identifying one or more selected-reaction-monitoring (SRM) transitions to be used for detecting the presence or quantity of the respective analyte; (b) for each of the one or more identified SRM transitions, determining a time duration required for a fragmentation reaction corresponding to the respective SRM transition to proceed to a certain threshold percentage of completion; (c) ionizing the sample in an ionization source of the mass spectrometer so as to produce one or more populations of first-generation ions; and (d) for each of the one or more identified SRM transitions, performing the steps of: (d1) isolating a sub-population of a one of the one or more populations of first-generation ions corresponding to a precursor-ion mass-to-charge (m/z) ratio associated with the respective SRM transition; (d2) fragmenting the respective isolated sub-population of ions in a one of two fragmentation cells of the mass spectrometer so as to produce a respective population of fragment ions; and (d3) analyzing, with a mass analyzer of the mass spectrometer, for the presence or quantity, among the respective fragment ions, of ions corresponding to a product-ion m/z ratio associated with the respective SRM transition, wherein, for each identified SRM transition, the fragmentation cell that is used for fragmenting the isolated sub-population of ions corresponding to the respective precursor-ion m/z ratio is determined from the time duration determined for the respective identified SRM transition.

According to yet another aspect of the present teachings, a method for operating a mass spectrometer so as to detect a presence of or a quantity of one or more analytes of a sample is disclosed, wherein the method comprises: (a) for each of the one or more analytes, identifying one or more selected-reaction-monitoring (SRM) transitions to be used for detecting the presence or quantity of the respective analyte; (b) for each of the one or more identified SRM transitions, determining a time duration required for a fragmentation step corresponding to the identified SRM transition to proceed to a certain threshold percentage of completion; (c) ionizing the sample in an ionization source of the mass spectrometer so as to produce one or more populations of first-generation ions; and (d) for each of the one or more identified SRM transitions, performing the steps of: (d1) isolating a sub-population of the one or more populations of first-generation ions corresponding to a precursor-ion mass-to-charge (m/z) ratio associated with the respective SRM transition; (d2) fragmenting the respective isolated sub-population of ions in a one of two portions of a partitioned fragmentation cell of the mass spectrometer so as to produce a respective population of fragment ions; and (d3) analyzing, with a mass analyzer of the mass spectrometer, for the presence or quantity, among the respective fragment ions, of ions corresponding to a product-ion m/z ratio associated with the respective SRM transition, wherein, for each identified SRM transition, the portion of the partitioned fragmentation cell that is used for fragmenting the isolated sub-population of ions corresponding to the respective precursor-ion m/z ratio is determined from the time duration determined for the respective identified SRM transition.

According to still yet another aspect of the present teachings, a method for operating a mass spectrometer so as to detect a presence of or a quantity of each of one or more analytes of a sample is disclosed, wherein the method comprises: (a) for each of the one or more analytes, identifying one or more selected-reaction-monitoring (SRM) transitions to be used for detecting the presence or quantity of the respective analyte; (b) for each of the one or more identified SRM transitions, determining a required limit of detection or a required limit of quantification of fragment ions corresponding to the respective SRM transition; (c) ionizing the sample in an ionization source of the mass spectrometer so as to produce one or more populations of first-generation ions; and (d) for each of the one or more identified SRM transitions, performing the steps of: (d1) isolating a sub-population of a one of the one or more populations of first-generation ions corresponding to a precursor-ion mass-to-charge (m/z) ratio associated with the respective SRM transition; (d2) fragmenting the respective isolated sub-population of ions in a one of two fragmentation cells of the mass spectrometer so as to produce a respective population of fragment ions; and (d3) analyzing, with a mass analyzer of the mass spectrometer, for the presence or quantity, among the respective fragment ions, of ions corresponding to a product-ion m/z ratio associated with the respective SRM transition, wherein, for each identified SRM transition, the fragmentation cell that is used for fragmenting the isolated sub-population of ions corresponding to the respective precursor-ion m/z ratio is determined from the required limit of detection or the required limit of quantification of fragment ions corresponding to the respective SRM transition.

BRIEF DESCRIPTION OF THE DRAWINGS

The above noted and various other aspects of the present invention will become apparent from the following description which is given by way of example only and with reference to the accompanying drawings, not drawn to scale, in which.

DETAILED DESCRIPTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The reader should be aware that, throughout this document, the term "DC" is used in accordance with its general usage in the art so as to mean "non oscillatory" without necessary implication of the existence of an associated electrical current. Thus, the usage of the terms "DC voltage", "DC voltage source", "DC power supply", "DC potential" etc. in this document are not, unless otherwise noted, intended to necessarily imply the generation or existence of an electrical current in response to the "DC voltage" or "DC potential" or to imply the provision of an electrical current by a "DC voltage source" or a "DC power supply". As used in the art and as used herein unless otherwise noted, the term "DC" is made in reference to electrical potentials (and not electrical current) so as to distinguish from radio-frequency (RF) potentials. A "DC" electrical potential, as commonly used in the art and as used herein, may be static but is not necessarily so. The particular features and advantages of the invention will become more apparent with reference to the appended FIGS. 1-17, taken in conjunction with the following description.

Figure 3:
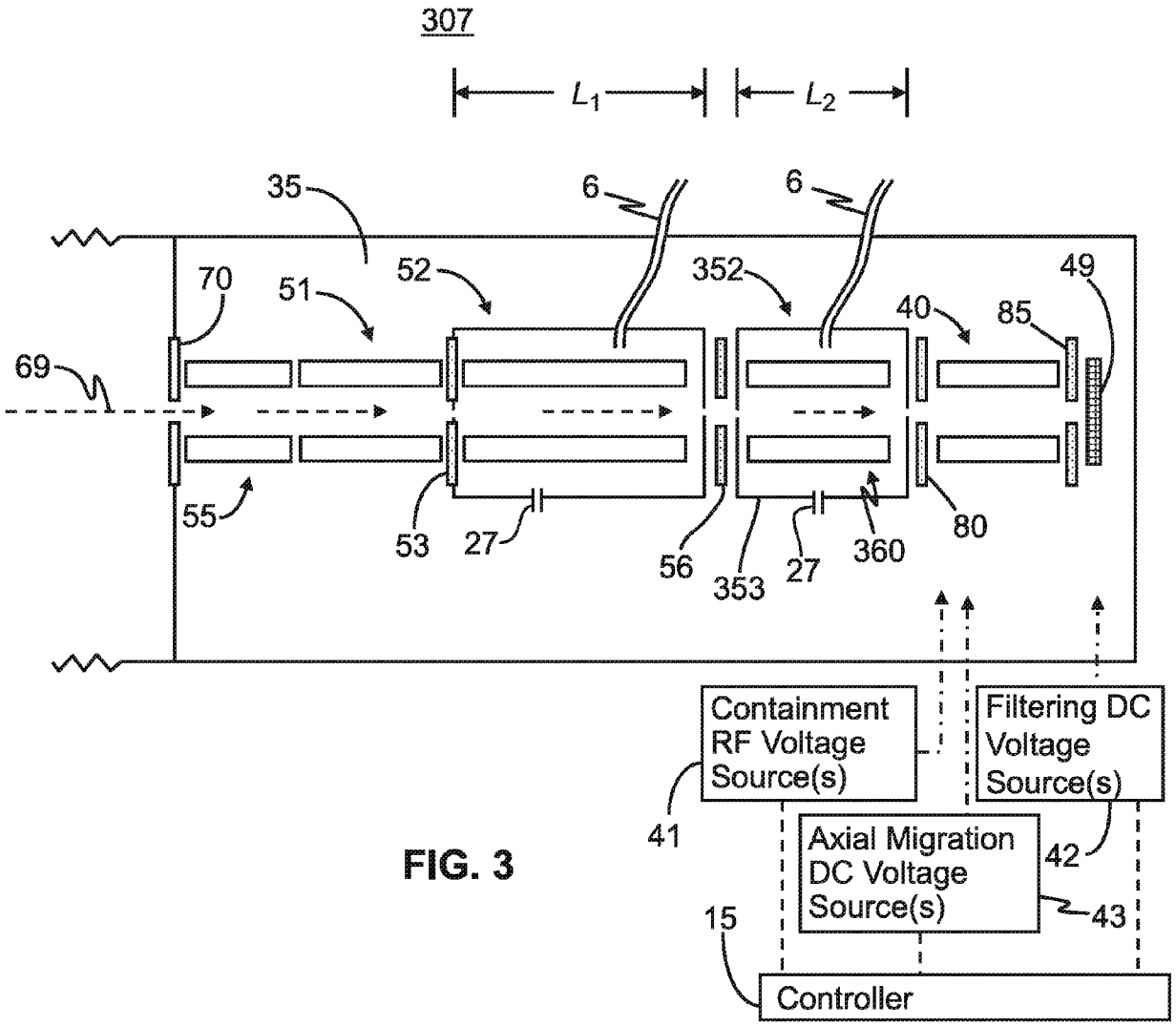
FIG. 3 is a schematic illustration of a portion of a first mass spectrometer system in accordance with the present teachings.

FIG. 3 illustrates a portion of a mass spectrometer system 307 in accordance with the present teachings. The system 307 illustrated in FIG. 3 is modified from a conventional triple quadrupole configuration (e.g., the configuration illustrated as system 1 in FIG. 1A) by incorporation of a secondary collision cell 352 that is, with respect to pathway 69 of ions through the mass spectrometer, in line with and downstream from the collision cell 52. The additional collision cell 352 is disposed between the previously-described collision cell 52 and the mass analyzer 40. The collision cell 52 comprises a length, $L_1$ and the additional collision cell 352 comprises a length $L_2$, where $L_2<L_1$. These lengths are taken along the ion pathway 69 between the between the ion inlet and the ion outlet of each cell. It should be noted that like reference numbers in FIG. 1A and FIG. 3 denote like components and that additional components of the system that are disposed to the left of the electrostatic lens 70 have been omitted from FIG. 3 for clarity. Such omitted components may be but are not necessarily configured identically to the configuration illustrated in FIG. 1A.

According to the exemplary configuration illustrated in FIG. 3, the secondary collision cell 352 includes a multipole 360 (which, preferably, is a quadrupole) which is contained within an enclosure 353 and which is operated in RF-only mode. A suitable inert gas which is provided into the enclosure 353 through a second gas inlet 6 provides neutral molecules that may absorb the kinetic energy of ions upon colliding with the ions. An additional ion lens 56 is disposed between the collision cell 52 and the secondary collision cell 352. An electrical potential difference between ion lens 53 and ion lens 56, disposed at opposite ends of collision cell 52 urges ions through the collision cell 52. Likewise, an electrical potential difference between ion lens 56 and ion lens 80, disposed at opposite ends of the secondary collision cell, propels the ions through the secondary collision cell 352.

Figure 2A:
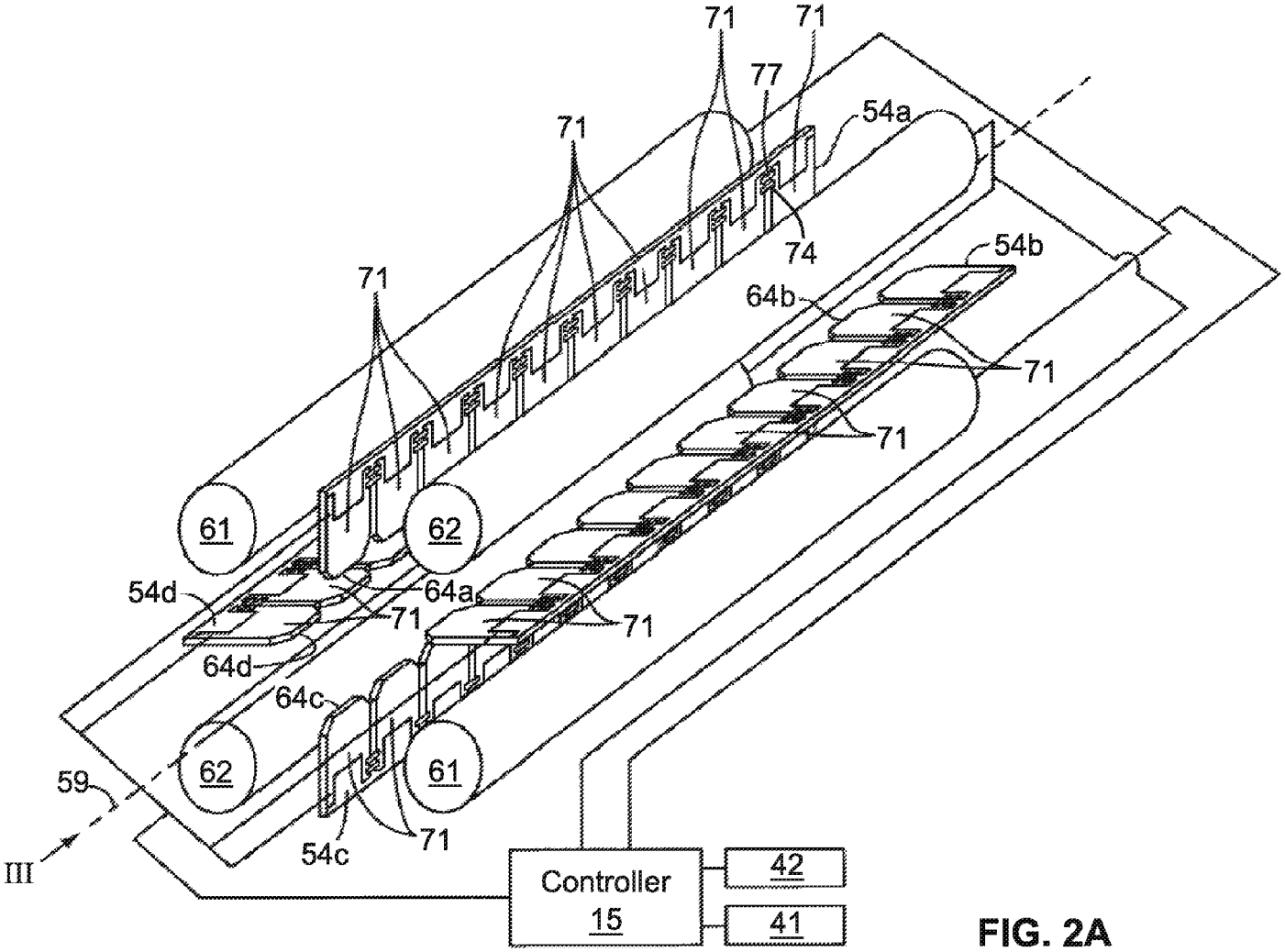
FIG. 2A (Prior Art)
FIG. 2A is a diagrammatic perspective view of a known multipole ion guide comprising rod electrodes and auxiliary electrodes.
Figure 2B:
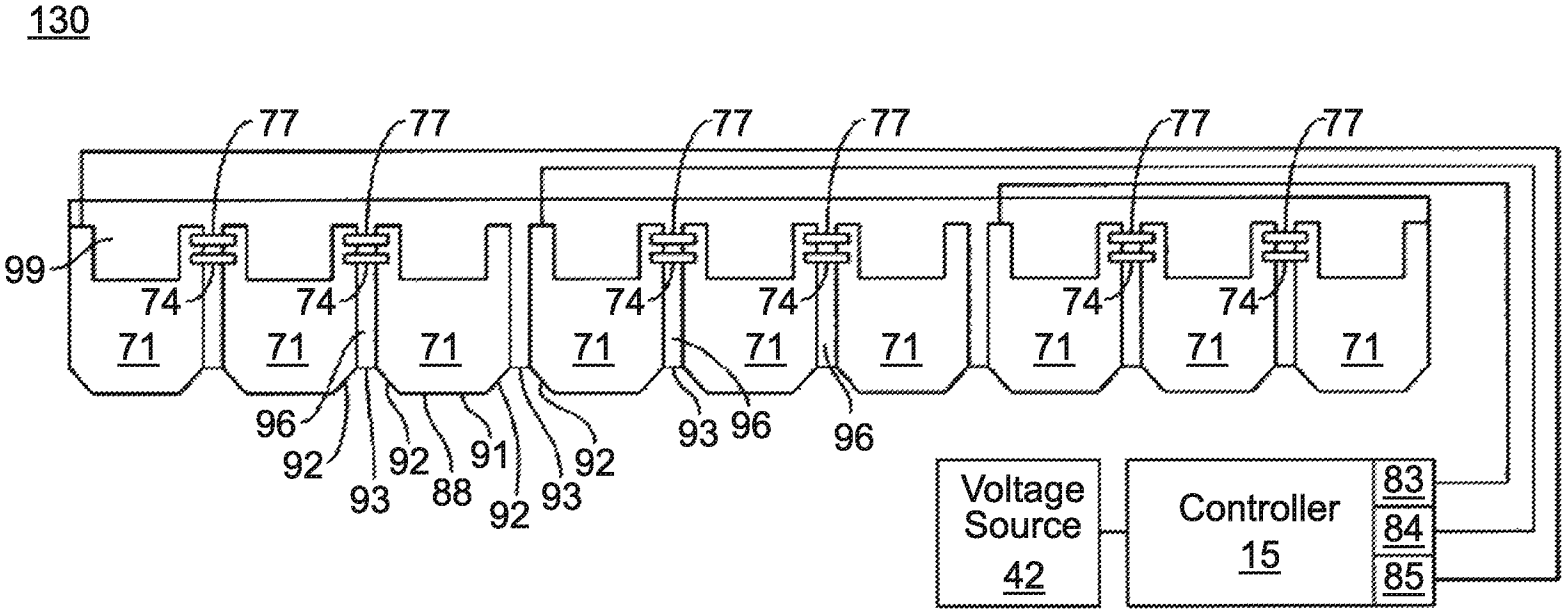
FIG. 2B (Prior Art)
FIG. 2B is diagrammatic top view of a known auxiliary electrode structure as may be employed in the multipole ion guide of FIG. 2A.

According to the exemplary configuration, illustrated in FIG. 3, the secondary collision cell 352 is structurally similar to the collision cell 52 except that is shorter in length as measured along the ion pathway 69 of ions towards the detector 49. The secondary collision cell 352 may thus be referred to as a "short" collision cell whereas the collision cell 52 may be referred to as a "long" collision cell. Preferably, the long and short collisions cells are configured so as to operate independently of one another. Accordingly, the electrical potential difference between the lens 53 and ion lens 56 preferably may be controlled independently of the electrical potential difference between ion lens 56 and ion lens 80. Further, each collision cell comprises its own respective collision gas inlet 6 and, optionally, its own collision gas vent 27, such that the pressure of a collision gas within each cell may be independently controlled by means of independent gas introduction and venting. Although not specifically illustrated, each vent 27 may be provided with a respective independently-controlled valve to enable control of gas venting from each respective collision cell. In various embodiments, either the collision cell 352 or the collision cell 52 (or both) may be supplemented by auxiliary electrodes as illustrated in FIGS. 2A-2B that, in operation, may be used to generate a DC drag field within the associated collision cell for urging ions to flow through the collision gas in the direction of the ion pathway 69.

The independent operation of the two collision cells 52, 352 (FIG. 3) enables different ion fragmentation conditions to be applied to each cell. Generally, the residence time of a packet of ions within the short collision cell 352 will be shorter than the residence time of a packet of ions within the long collision cell 52. In this sense, the term "packet" refers to a collection of precursor ions that enter a collision cell within a certain restricted time range as well as to any product ions generated from those precursor ions within the collision cell. Also, the term "residence time" refers to the average time duration between the introduction of the collection of precursor ions into the collision cell and the exit of the respective packet of ions from the collision cell. Because of the different residence times associated with the two collision cells, the short collision cell 352 is efficient for conducting a series of fragmentation reactions that are kinetically relatively fast. However, the short collision cell may be unsuitable for conducting fragmentation reactions that are kinetically relatively slow, since such reactions may not proceed to completion in the short collision cell. For such slower reactions, the long collision cell 52 may be employed. In operation, only one of the two collision cells will be employed for ion fragmentation at any particular time. The unused collision cell at any such time is generally used as a pass through cell or simple ion guide by maintaining the interior of the unused cell at a high vacuum.

If a mass spectrometer is to be employed for conducting a plurality of SRM experiments including transitions comprising a range of fragmentation kinetics, then the system illustrated in FIG. 3 may be extended by the provision of additional collision cells—for example, a third and possibly subsequent collision cells—comprising different respective lengths along the ion pathway 69. In such a configuration, the length of each cell is inversely related to the speed of fragmentation reactions to be conducted within it. Alternatively, a single collision cell may be employed in a similar fashion by the provision of internal partitions as schematically illustrated by the collision cell 252 in accordance with the present teachings shown in FIG. 4A. The single, integrated collision cell 252 illustrated in FIG. 4A comprises a single set of rods 61, 62 (rods 62 not shown in FIG. 4A—see FIG. 1E for positions) within a single housing 57. The collision cell 252 further comprises one or more internal partitions 221 that divide the interior of the single collision cell into two or more internal compartments 240. Each such compartment comprises its own respective independently controllable collision gas inlet 6 and collision gas vent 27 such that the pressure of a collision gas within each compartment may be independently controlled by means of independent gas introduction and venting. Although not specifically illustrated, each vent 27 may be provided with a respective independently-controlled valve to enable control of gas venting from each respective compartment.

The internal partitions 221 of the partitioned collision cell 252 serve to isolate the introduced collision gas to a desired compartment or multiple-compartment portion of the collision cell. The collision gas may be introduced into the desired compartment or compartments by choosing which gas inlet 6 (or inlets) through which the collision gas is introduced. Valves (not shown) provided with collision gas vents 27 of the compartment or compartments that are to receive the collision gas may be maintained in a closed position so as to retain the collision gas in those compartments. At the same time, valves provided with collision gas vents 27 of other compartments may be maintained in open position so that those latter compartments are maintained under high vacuum by the mass spectrometer vacuum system. By such operation, the collision cell may be partitioned into both a "short portion" and a "long portion" whereby the relative lengths of the long and short portions (along the ion pathway 69) are variable.

Figure 4A:
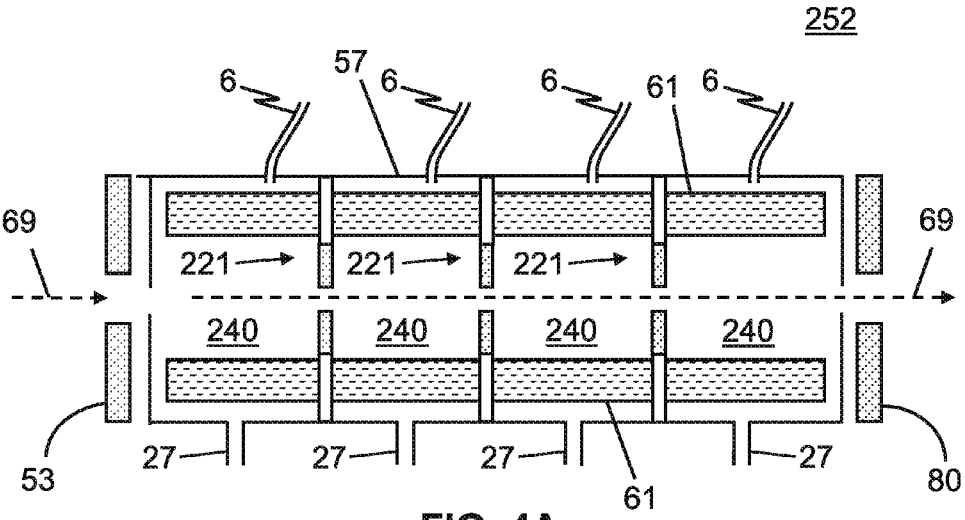
FIG. 4A is a schematic illustration of a partitioned ion fragmentation cell in accordance with the present teachings.
Figure 4B:
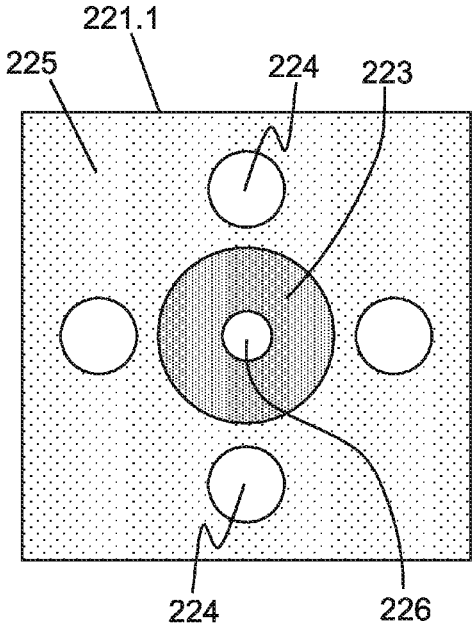
FIG. 4B is a schematic illustration of the structure of a partition as may be employed in the partitioned ion fragmentation cell of FIG. 4A.
Figure 4C:
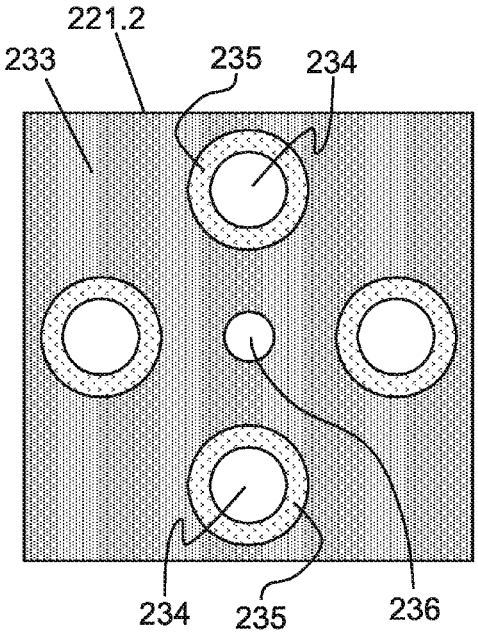
FIG. 4C is a schematic illustration of structure of another partition as may be employed in the partitioned ion fragmentation cell of FIG. 4A.

In addition to their function of constraining which compartments of the collision cell 252 are maintained with an elevated pressure of collision gas, the partitions 221 may also serve as internal electrodes capable of applying an internal drag electric field or axial electrical field within the collision cell. FIGS. 4B-4C illustrate two embodiments of such partitions. The partition 221.1 comprises a plate or vane 225 of an electrically insulating material provided with apertures 224 through which the rod electrodes 61, 62 pass and by which the rod electrodes may be at least partially mechanically supported. Another aperture 226 disposed centrally between the apertures 224 permits transfer of ions through the partition and, thus, between compartments 240. An electrode 223, which may be a separate conductive component affixed to the central portion of the insulative vane 225 or may alternatively comprise a conductive coating on the vane 225, surrounds the aperture and is electrically coupled to a DC voltage source 43 (see FIG. 1A) by an electrical coupling (not shown).

The partition 221.2 illustrated in FIG. 4C comprises a plate or vane 233 of an electrically conducting material (such as a metal) that is electrically coupled to the DC voltage source 43. Thus, the plate or vane 233 is itself an electrode. An aperture 236 provided in the vane 233 permits transfer of ions through the partition 221.2 and, thus, between compartments 240. Electrically insulating inserts 235 that are affixed to the plate or vane 233 are provided with apertures 234 through which the rod electrodes 61, 62 pass.

Each compartment 240 of the collision cell 252 is bounded by either two partitions 221, each comprising an ion aperture 226, 236 or by a single apertures partition and an apertured wall of the housing 57 of the collision cell. Thus each compartment 240 comprises its own respective compartment ion inlet aperture and ion outlet aperture. The collection of electrodes 223 (FIG. 4B) or 233 (4C) and the entrance and exit lenses 53, 80 may be electrically coupled to a DC power supply that and electrical potential gradient may be applied along the ion path direction 69 between the compartment ion inlet aperture and the compartment ion outlet aperture of each compartment. The various electrical couplings between the partitions and between the partitions and the DC power supply may be configured as described above with regard to FIGS. 2A-2B.

Figure 5:
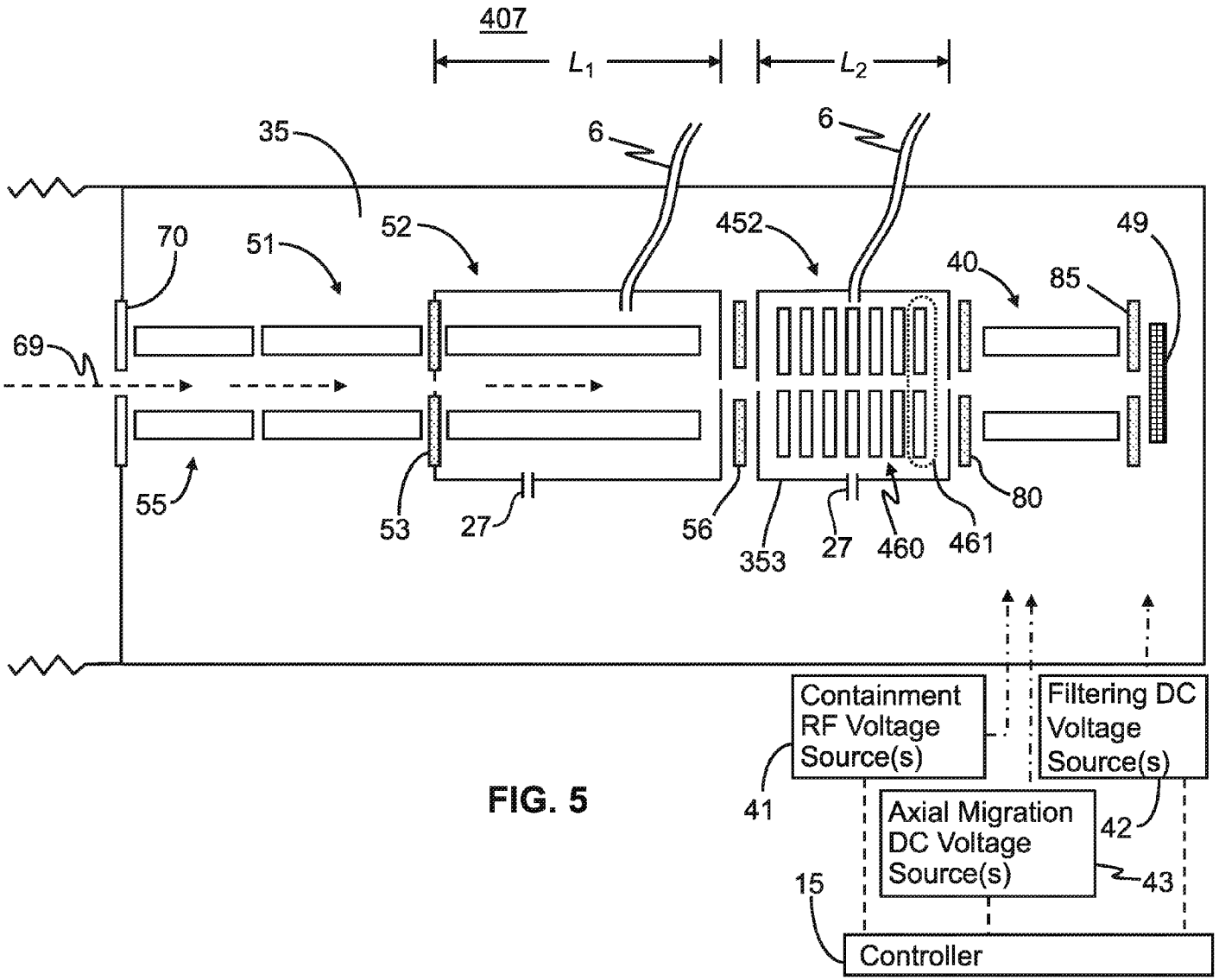
FIG. 5 is a schematic illustration of a portion of another mass spectrometer system in accordance with the present teachings.

FIG. 5 illustrates a portion of another mass spectrometer system in accordance with the present teachings. In similarity to the mass spectrometer system 307 illustrated in FIG. 3, the system 407 shown in FIG. 5 comprises two collision cells consisting of a long collision cell 52 comprising a length, $L_1$ and a short collision cell 452 comprising a length $L_2$, where $L_2<L_1$. Each of these two collision cells comprises its own respective collision gas inlet 6 and its own collision gas vent 27 as previously described. Also, each collision cell 52, 452 comprises its own respective electrical connections such that the operation of each collision cell may be fully controlled, independently of the other cell.

Figure 1A:
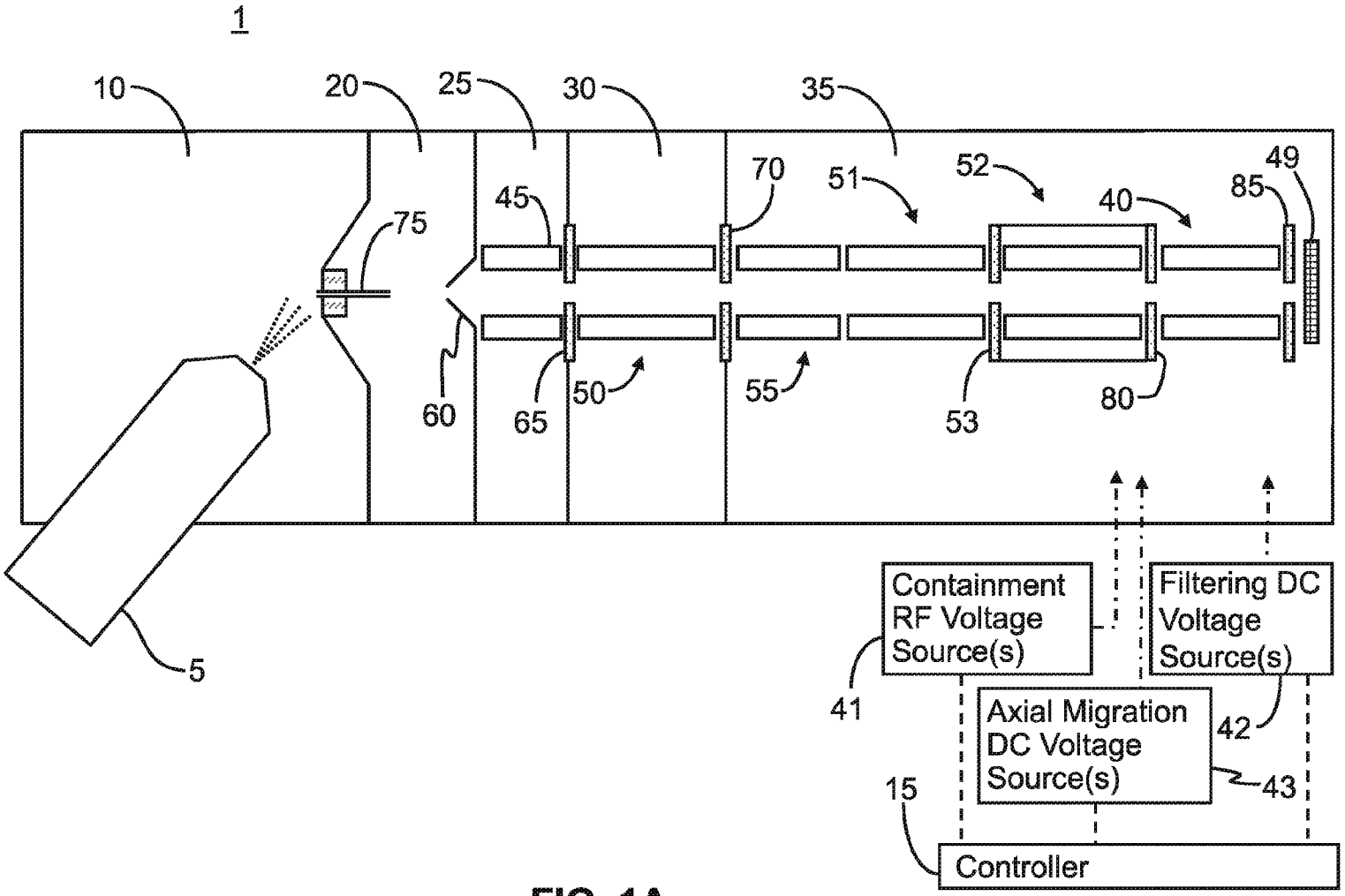
FIG. 1A (Prior Art)
FIG. 1A is a schematic diagram showing components of a conventional mass spectrometer system.
Figure 1B:
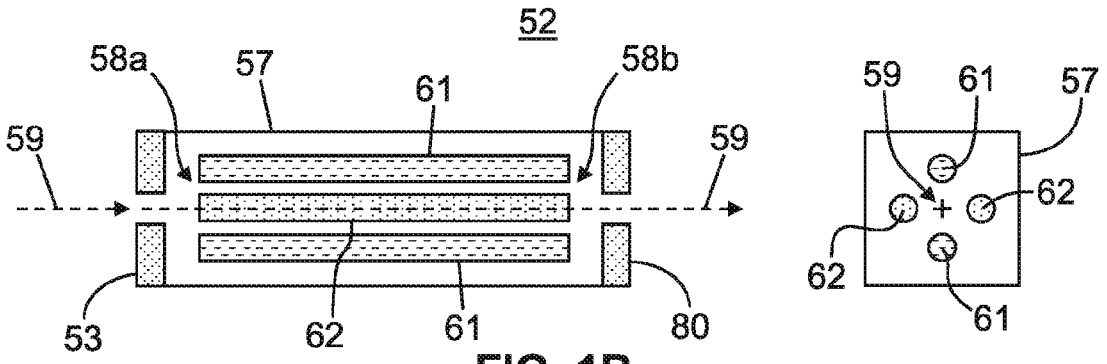
FIG. 1B (Prior Art)
FIG. 1B is a schematic illustration of a conventional quadrupolar collision or reaction cell.
Figure 1C:
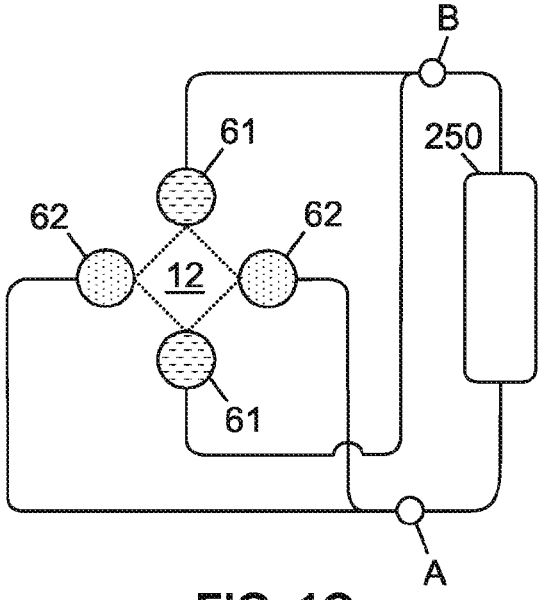
FIG. 1C (Prior Art)
FIG. 1C is a schematic diagram of typical electrical connections for a quadrupolar collision cell or reaction cell.
Figure 1D:
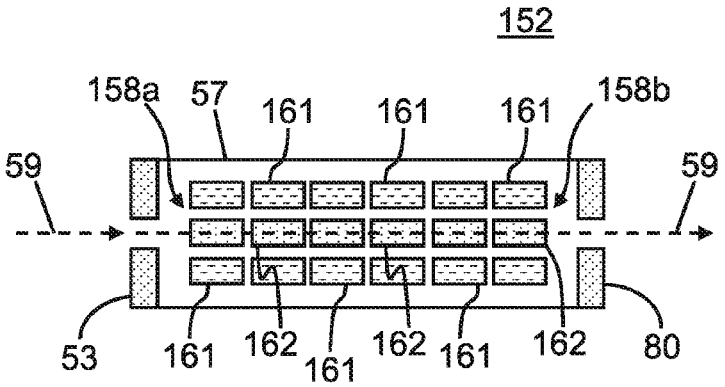
FIG. 1D (Prior Art)
FIG. 1D is a schematic illustration of a known segmented quadrupolar collision or reaction cell.
Figure 1E:
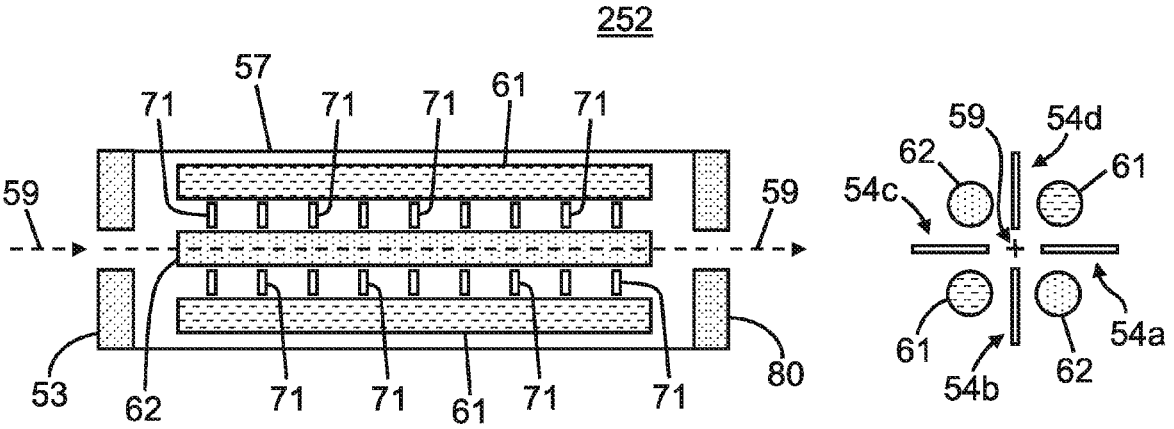
FIG. 1E (Prior Art)
FIG. 1E is a schematic illustration of a known alternative quadrupolar collision or reaction cell that includes auxiliary electrodes.

The short collision cell 452 shown in FIG. 5 differs from the collision cell 352 shown in FIG. 3 in that each individual multipole rod of the cell 352 is replaced, in the cell 452, by a plurality of rod segments along the ion pathway 69 in a fashion similar to that shown in FIG. 1D. The segmented multipolar system is indicated as segmented rod set 462. Each multipolar segment 461 (one of which is outlined in FIG. 5) consists of a set consisting of one segment of each segmented rod. For example, if the multipole rod set is a quadrupolar rod set, then each multipolar segment 461 consists of one segment of each of the four segmented rods. In operation of the collision cell 452, each separate multipole segment may be supplied with a different DC electrical potential such that an electrical potential gradient (i.e., a drag field) is generated that urges ions through the collision cell in the direction of the arrows along ion pathway 69. Although not specifically illustrated in FIG. 5, the long collision cell 52 may be segmented in a similar fashion.

In alternative embodiments, the set of rods of the collision cell 452 may be replaced by a set of stacked ion plate electrodes, in a stacked-ring ion guide or ion tunnel configuration, where each plate comprises an aperture through which the ions pass. An RF voltage is applied to the plate electrodes, with alternating electrodes being supplied with voltages that are exactly out of phase. Further, the plate electrodes may be electrically coupled to a DC power supply using a voltage divider chain such that an electrical potential gradient is formed between each pair of adjacent electrodes.

Figure 6:
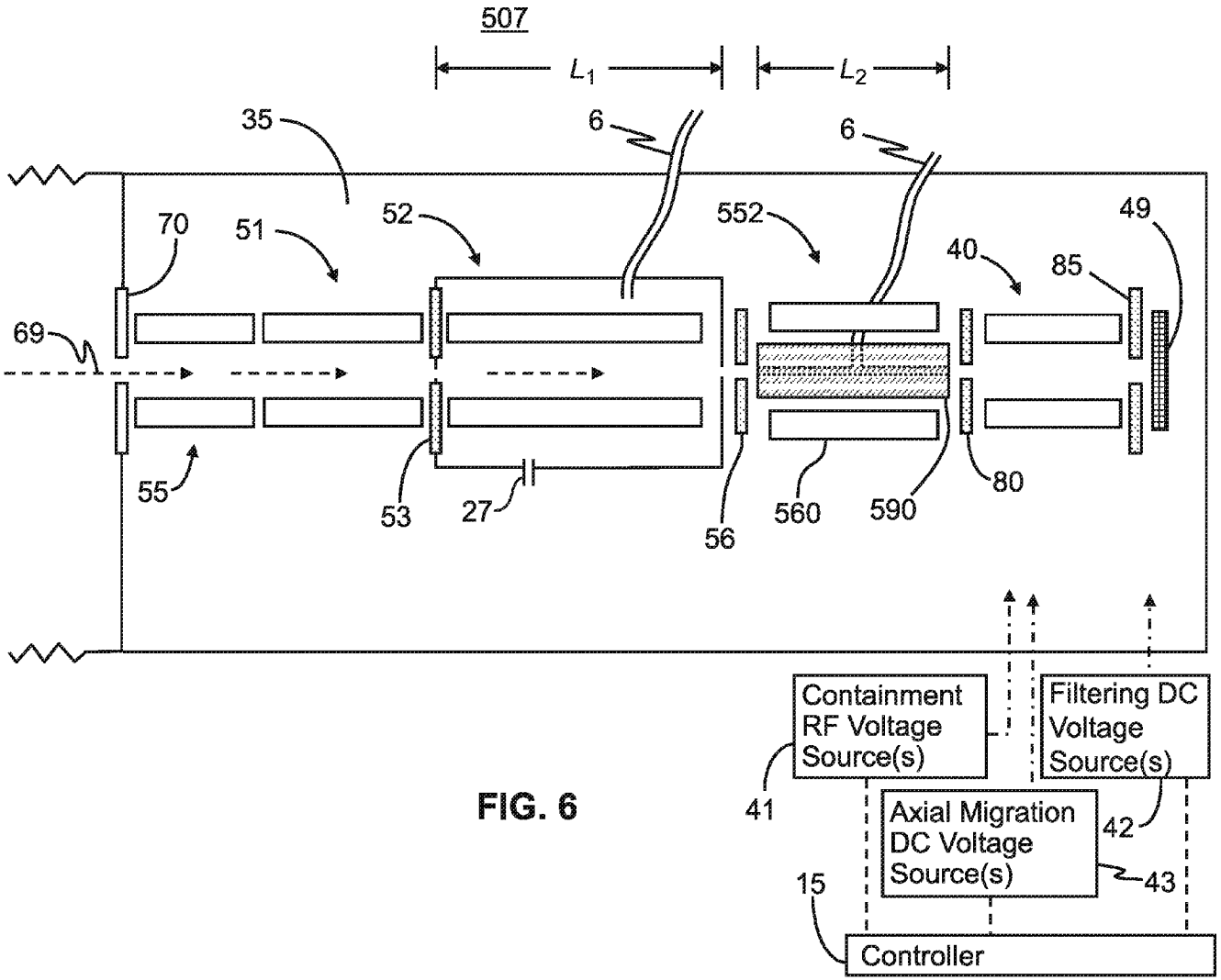
FIG. 6 is a schematic illustration of a portion of still another mass spectrometer system in accordance with the present teachings.

FIG. 6 illustrates a portion of another two-collision cell mass spectrometer system 507 in accordance with the present teachings in which a drag field is provided within the short collision cell 552 by application of voltage across the two ends of a tube 590 that comprises a lossy dielectric material. One example of such material is so called "resistive glass". as described in U.S. Pat. No. 5,736,740 or U.S. Pat. No. 7,935,922. Suitable materials have resistivity greater than that of a perfect dialectric but significantly less than that of a metal conductor. For example, the resistive tube member 52*a* may be formed of any one of a number of materials (e.g., without limitation, doped glasses, cermets, polymers, metallic oxides, doped glasses, metal films, ferrite compounds, carbon resistive inks, etc.) having electrically resistive properties. The tube may be fabricated from the resistive material or may employ the resistive material as a coating, such as a coating of ruthenium oxide, on either the interior or exterior of a conventional glass tube or a tube formed of an insulator material. It is also possible to generate a resistive coating on a glass surface by, for example, chemical reactions (U.S. Pat. No. 7,081,618). Such tubes are commercially available, e. g. under the name FieldMaster™ from Burle Electro-Optics Inc., Sturbridge Mass. (USA). In the system 507 shown in FIG. 6, the multipole rod set 560 is disposed exteriorly to the resistive tube 590. Because collision gas is supplied directly into the lumen of the resistive tube from collision gas inlet 6, a separate housing is not required to enclose the rod set 560 which may remain under high vacuum conditions. Although not specifically illustrated in FIG. 6, the long collision cell 52 may employ a resistive tube in a similar fashion.

During conventional operation of collision cells, precursor ions entering the cell are provided with an amount of initial kinetic energy such that is sufficient to, upon collision of these ions with molecules of collision gas, impart a sufficient amount of bond vibrational energy to the precursor ions to cause chemical bond breakage and fragmentation. In this process, a portion of the initial precursor ion kinetic energy is absorbed by the bond breakage and another portion is converted to thermal energy of gas molecules. However, there will generally be an excess of the initial precursor-ion kinetic energy that is taken up as residual kinetic energy of the fragment ions and of any unreacted precursor ions. Conventionally, the collision cell interior is provided with a sufficient pressure of a collision gas (e.g., greater or equal than 0.5 mtorr) and is of sufficient length such that such residual kinetic energy is absorbed by further (lower energy and non-reactive) collisions with the gas molecules. Thus, the gas in the collision cell not only causes precursor-ion fragmentation but also provides "collisional cooling" of the resulting fragment ions.

During operation of apparatuses described herein, if fragmentation is caused to occur in a short collision cell (i.e., collision cell 352 shown in FIG. 3, collision cell 452 shown in FIG. 5, collision cell 552 shown in FIG. 6 or one or more short compartments 240 as illustrated in the collision cell 252 of FIG. 4A) or in a collision cell in which the gas pressure is less than 0.5 mtorr (or both), then each fragment ion may not collide a sufficient number of gas molecules to fully damp its residual kinetic energy. In such a case, the excess kinetic energy will cause the cloud of such energetic fragment ions to occupy a wider than desirable volume about the collision cell central axis—in other words, there will be poor confinement of the energetic fragment ions to the axial region. It has been found that that, when a of collection of fragment ions of various fragment ion species is formed, the residual kinetic energy is partitioned or distributed among the species in a manner that is mass dependent. If the collection of fragment ions having the distributed excess kinetic energy is then transferred to a mass analyzer, such as mass analyzer 40 shown in FIG. 3, then there will be incomplete transmission of fragment ions through the mass analyzer to a detector (e.g., detector 49) during a mass scan, as a result of the less than optimal confinement of the fragment ions to the axial region at the time of entry into the mass analyzer. Further, the quality of the transmission will be mass dependent, thereby leading to erroneous determinations of relative abundances of fragment ions.

To counteract the undesirable spectral effects of mass-dependent distribution of excess energy among fragment ions, various embodiments of methods for operating a mass spectrometer in accordance with the present teachings may employ a mass-dependent control of offset voltage between a collision cell and a subsequent mass analyzer. The offset voltage is a non-oscillatory DC electrical potential difference between the collision cell multipole rods and either an entrance lens or the quadrupole rods of the mass analyzer. The offset voltage serves to urge analyte ions along a continuous pathway through the collision cell into the mass analyzer.

During a typical mass scan of the fragment ions, the RF voltage, U, and mass discriminating DC voltage, V, that are applied to the mass analyzer quadrupole rods are ramped (increased) in proportion to one another such that ions of progressively greater m/z ratios develop stable trajectories through the mass analyzer and are thus transmitted through the mass analyzer to the detector. The utilization of mass-dependent control of offset voltage, as may be required by various embodiments of methods in accordance with the present teachings, corresponds to a variation of the offset voltage in synchronicity with the ramping of the U and V voltages. By this means, the offset voltage is caused to vary such that the additional translational kinetic energy imparted by the offset voltage is at its lowest value at the time that ions having the greatest amount of excess residual kinetic energy are being transmitted by the mass analyzer and is at its greatest value at the time that ions having the least amount of excess residual kinetic energy are being so transmitted (and is at appropriate intermediate values at times when other ions are being so transmitted). The variation of mass analyzer offset voltage in this mass-dependent fashion has previously been employed in early versions of triple quadrupole mass spectrometers.

Figure 7:
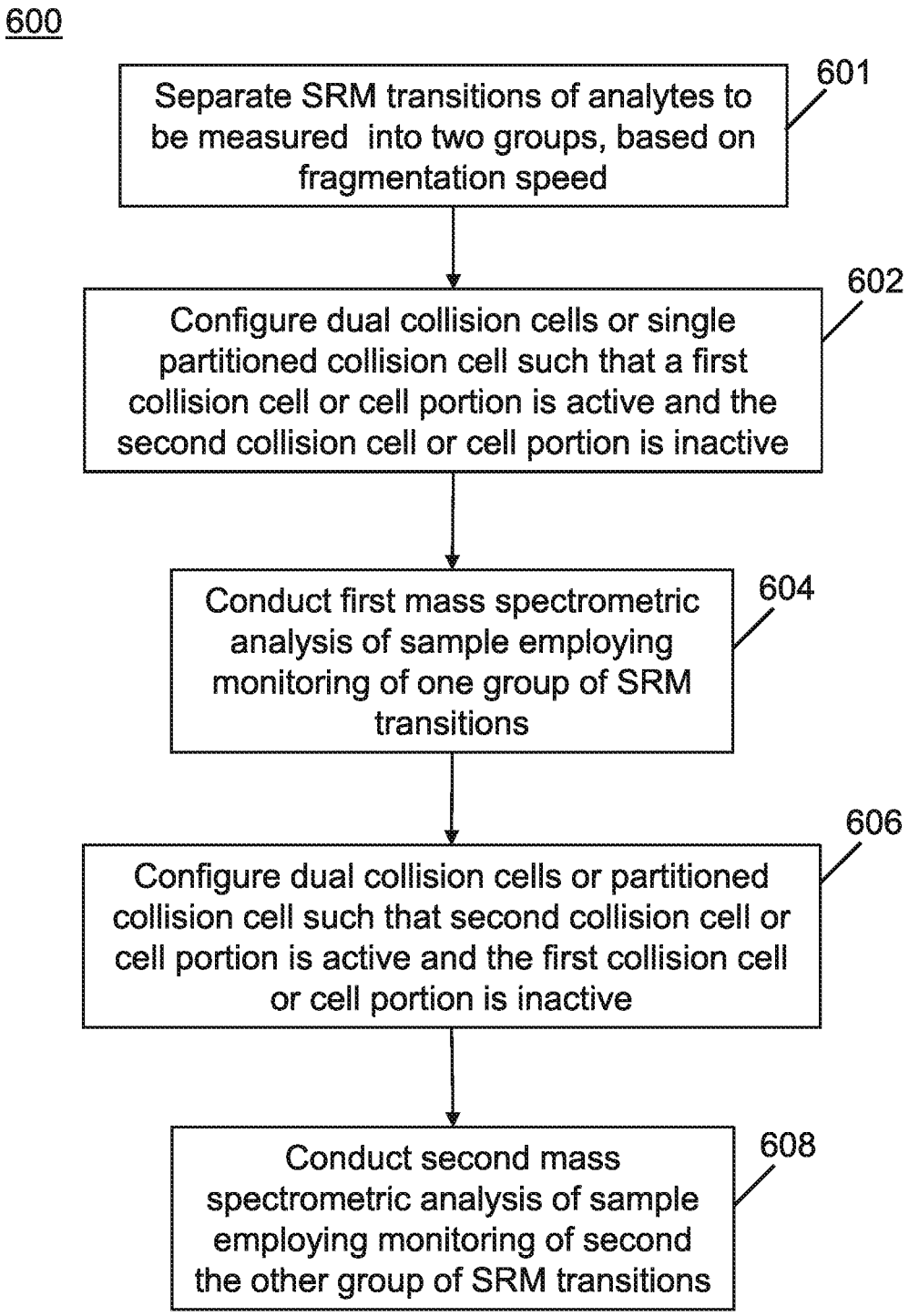
FIG. 7 is a flow chart of a method for performing mass spectrometric analyses in accordance with the present teachings.
Figure 8A:
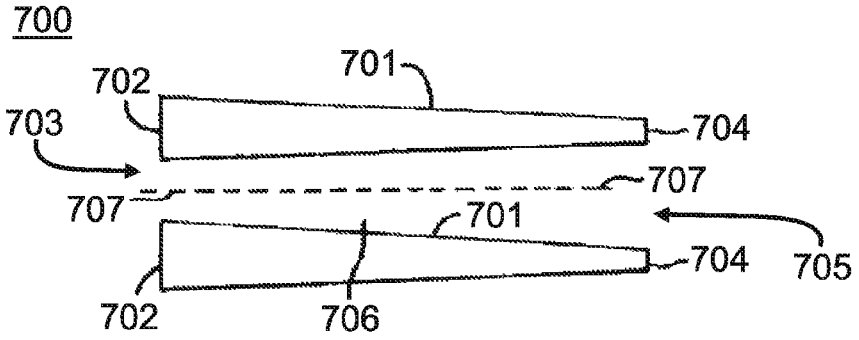
FIG. 8A (Prior Art)
FIG. 8A is side view of a known configuration of two rods of a tapered rod set for use in generating an axial field along a central axis of a quadrupole apparatus of a mass spectrometer.
Figure 8B:
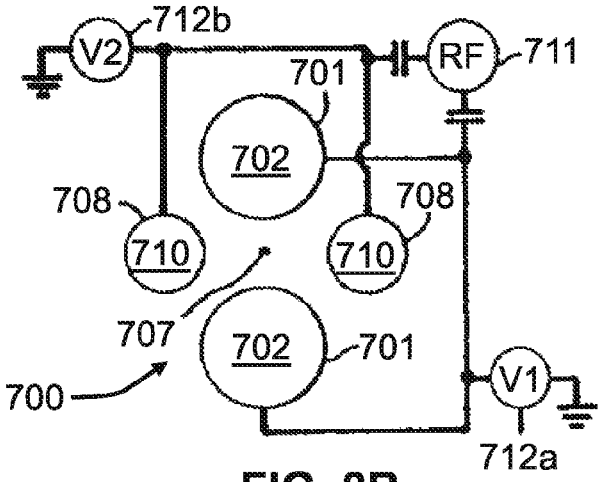
FIG. 8B (Prior Art)
FIG. 8B is an end view of the entrance end of the known rod set configuration of FIG. 8A.
Figure 8C:
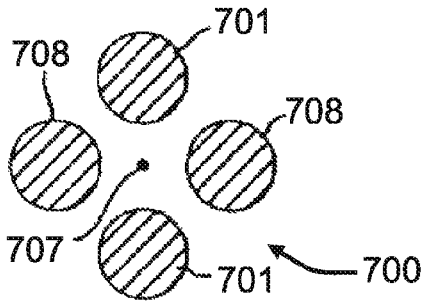
FIG. 8C (Prior Art)
FIG. 8C is a cross-sectional view at the center of the known rod set configuration of FIG. 8A.
Figure 8D:
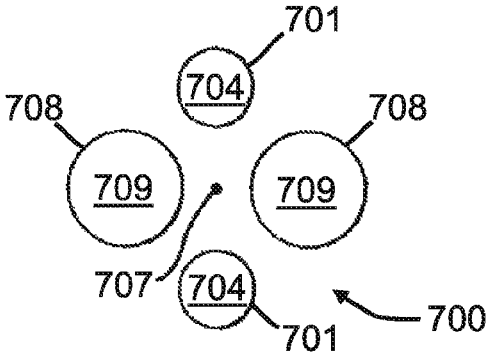
FIG. 8D (Prior Art)
FIG. 8D is an end view of the exit end of the known rod set configuration of FIG. 8A.
Figure 9:
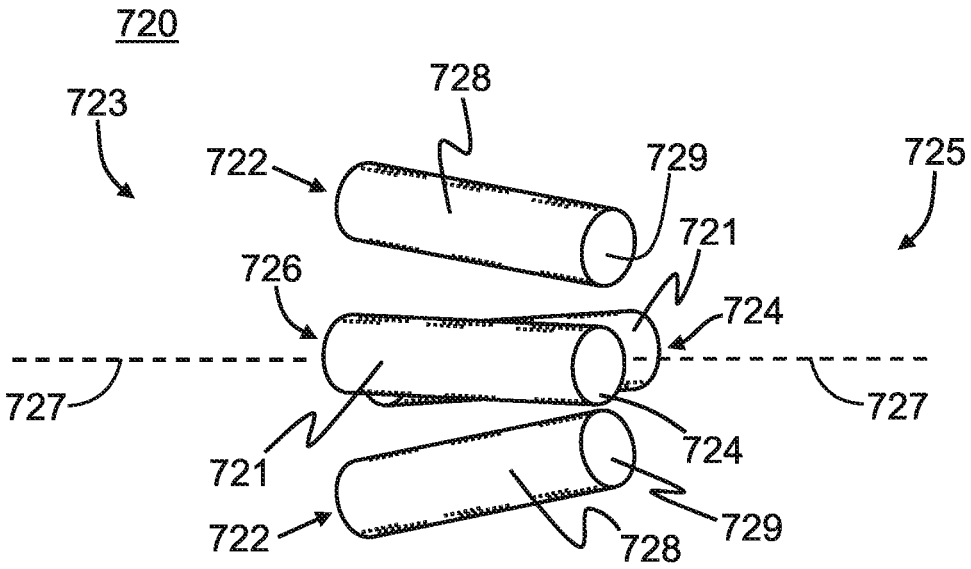
FIG. 9 (Prior Art)
FIG. 9 is a side view of two rods of another known rod set configuration for use in generating an axial field along a central axis of a quadrupole apparatus of a mass spectrometer.
Figure 10:
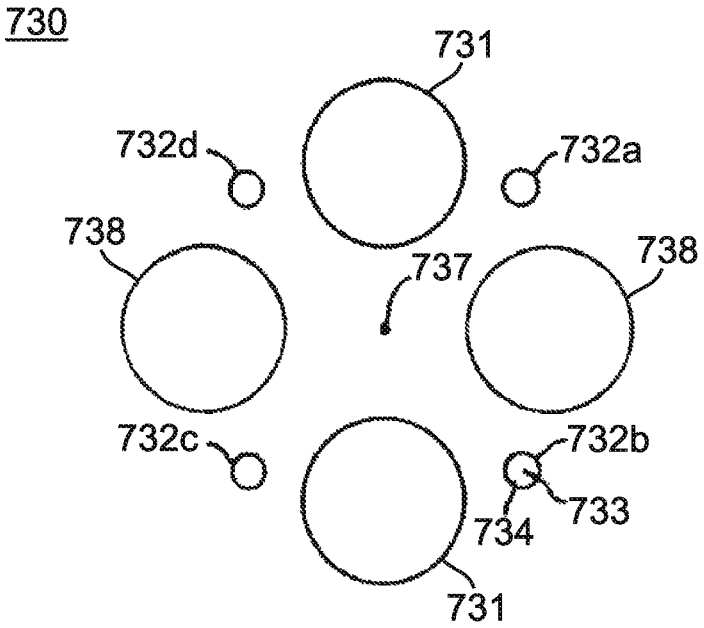
FIG. 10 (Prior Art)
FIG. 10 is an end view of a known quadrupole apparatus comprising a set of auxiliary resistive rods for use in generating an axial field along a central axis of a quadrupole apparatus of a mass spectrometer.
Figure 11:
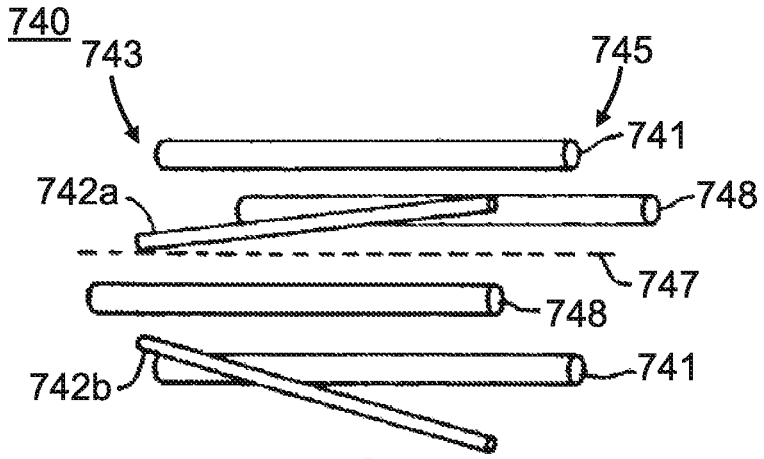
FIG. 11 (Prior Art)
FIG. 11 is a side view of a known quadrupole apparatus comprising a set of angled conductive auxiliary rod electrodes for use in generating an axial field along a central axis of a quadrupole apparatus of a mass spectrometer.
Figure 12:
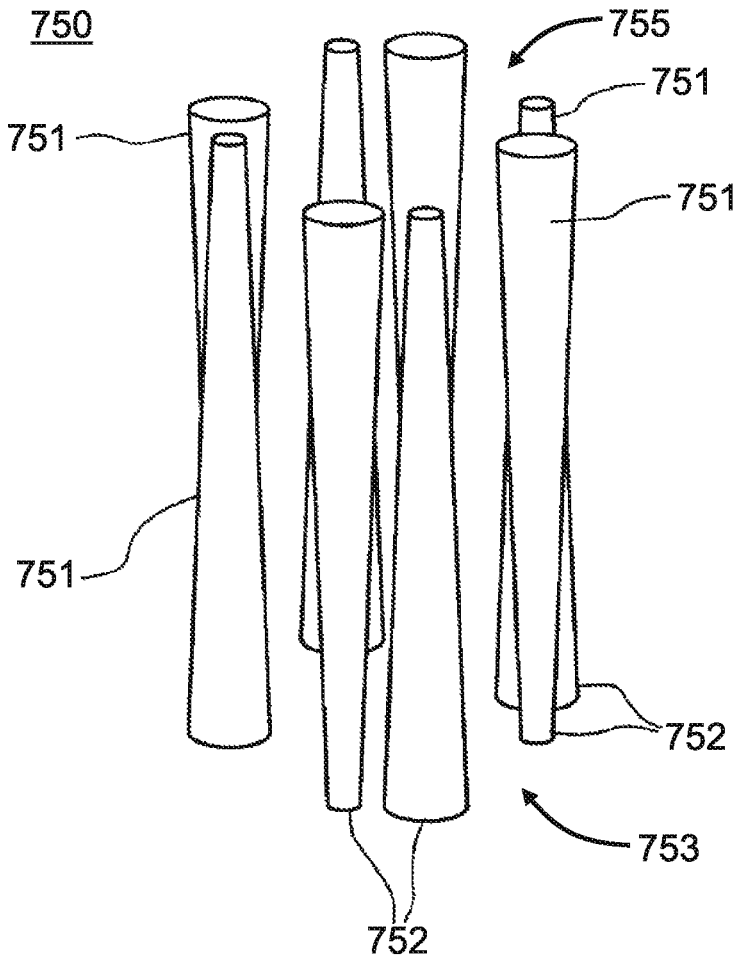
FIG. 12 (Prior Art)
FIG. 12 is a perspective view of a known configuration of quadrupole electrodes for use in generating an axial field along a central axis of a quadrupole apparatus of a mass spectrometer, wherein the electrodes of the quadrupole apparatus are disposed in tapered electrode pairs.
Figure 13A:
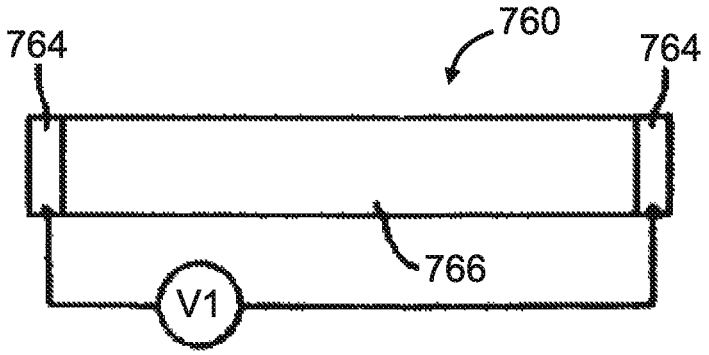
FIG. 13A (Prior Art)
FIG. 13A is a side view of a single rod of a quadrupole or multipole rod set that is modified in a known fashion for use in generating an axial field along a central axis of a quadrupole or other multipole apparatus of a mass spectrometer.
Figure 13B:
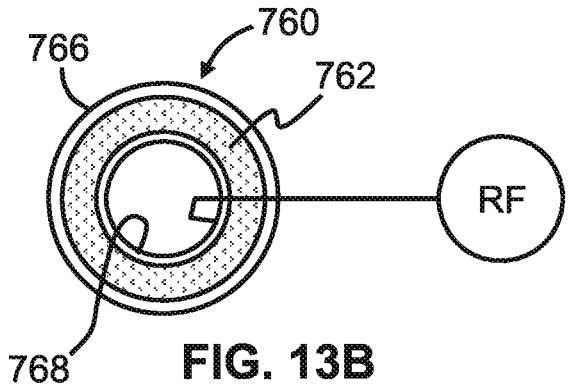
FIG. 13B (Prior Art)
FIG. 13B is a cross-sectional view at the center of the rod of FIG. 13A.
Figure 15:
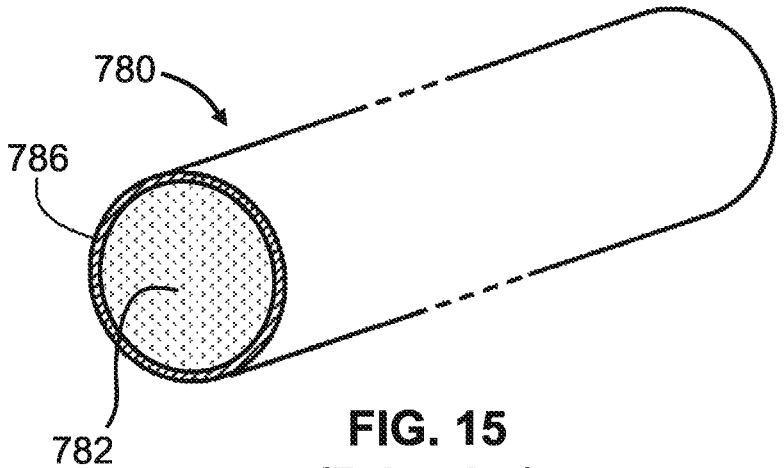
FIG. 15 (Prior Art)
FIG. 15 is a schematic is a schematic view of two rods of a multipole ion guide apparatus that comprises, in a known fashion, a resistive coating on an insulating core.
Figure 14:
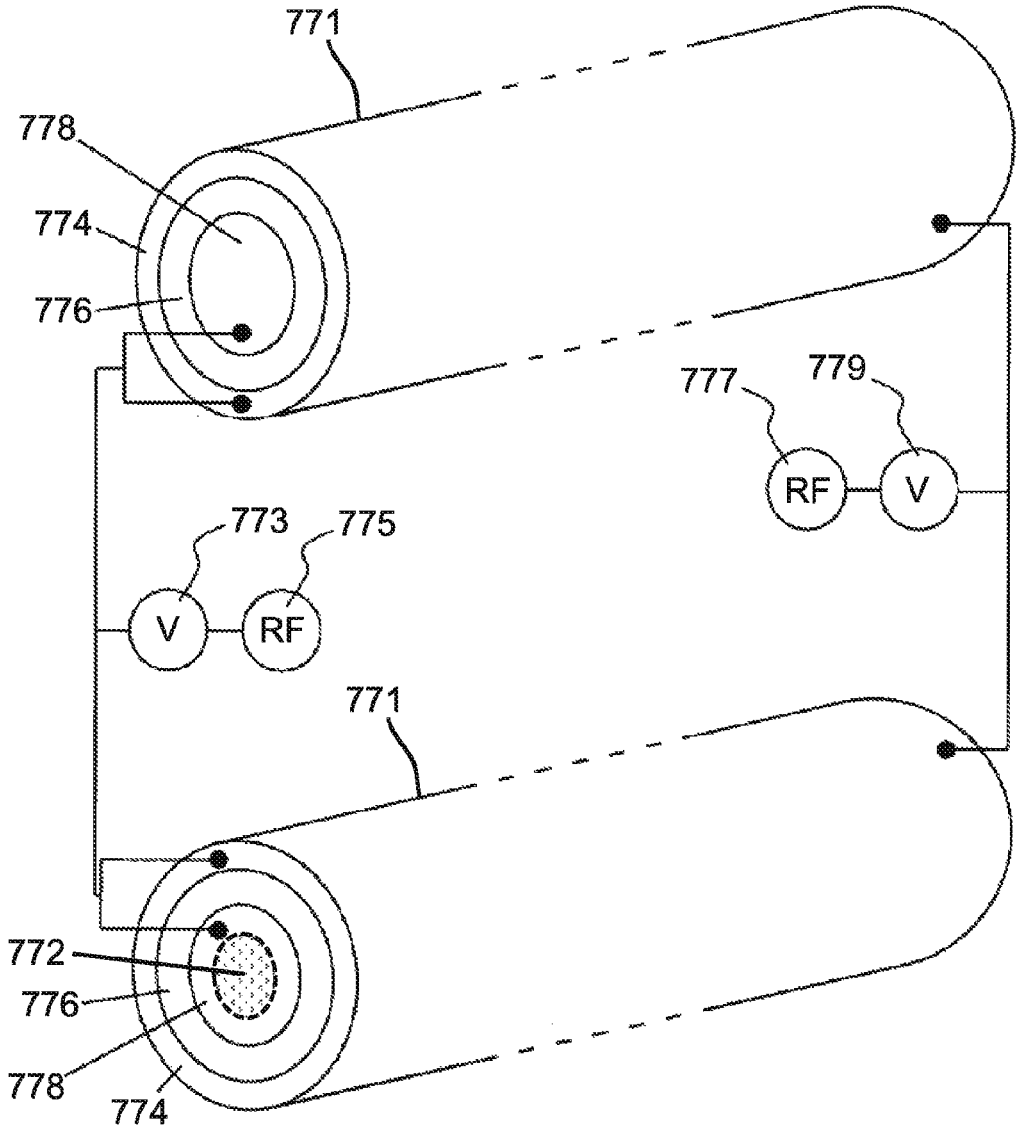
FIG. 14 (Prior Art)
FIG. 14 is a schematic view of two rods of a multipole ion guide apparatus that comprises, in a known fashion, conductive, resistive and insulating layers and showing a known configuration of electrical connections between even-numbered or odd-numbered rods.
Figure 16:
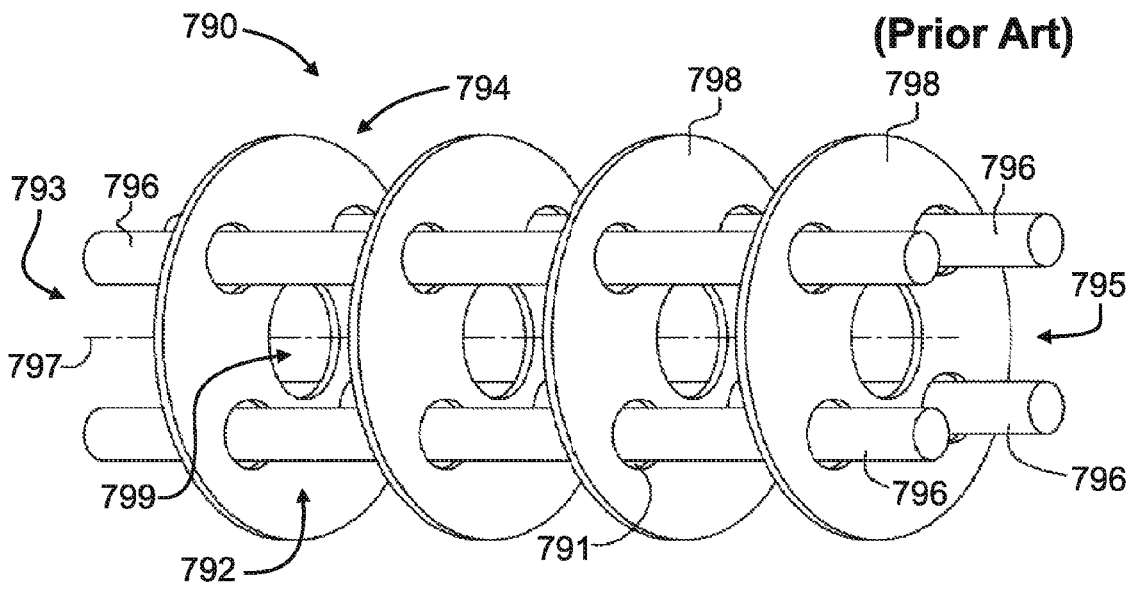
FIG. 16 (Prior Art)
FIG. 16 is a perspective view of a known ring pole ion transport apparatus capable of generating an axial field directed along a central axis of the apparatus.

FIG. 7 is a flow chart of a method in accordance with the present teachings for operating a mass spectrometer system to detect or measure particular analytes of a sample. The method 600 illustrated in FIG. 7 assumes that the sample is analyzed by performing a pre-determined plurality of SRM transitions. The method also assumes that a mass spectrometer system either comprises two collision cells—a long cell and a short collision cell, serially arranged along an ion pathway—as illustrated, for example, in FIG. 3, FIG. 5 or FIG. 6 or comprises a single partitioned collision cell as illustrated in FIG. 4A. In the following discussion, the expression "first collision cell" may refer to either of the two collision cells and is not intended to imply reference to the long collision cell or to the first cell in series along the pathway. Likewise, the expression "second collision cell" refers to the collision cell that is other than the "first collision cell" and is not intended to imply reference to the short collision cell or to the second cell in series along the pathway. Further, references a portion (either a first portion or a second portion) of a partitioned collision cell refers to a set of one or more cell chambers as illustrated in FIG. 4A that are not separated, one from another, by any intervening chamber and that function as a unit. Generally, a partitioned cell will be apportioned, when appropriate, into exactly two portions. References to a first portion and to a second portion in the following discussion are not intended to imply which of the two portions is closest to the ion inlet to the partitioned cell; either the first or the second portion may be closest to the ion inlet.

In the first step, step 601, of the method 600, the SRM transitions are divided into two groups based on the kinetics of fragmentation of the respective precursor species to be isolated as part of each SRM. For example, the division might be made with reference to a pre-determined time (e.g., number of microseconds) required for a fragmentation step to proceed to completion to a certain percentage of completion. Then, the SRM transitions requiring less time than the pre-determined number of microseconds might be assigned to a "fast fragmentation" group whereas the remaining transitions are assigned to a "slow fragmentation" group.

In step 602, the dual collision cells or the partitions of the partitioned collision cell are configured in preparation for a first mass analysis of the sample (i.e., in subsequent step 604). During the first mass analysis of the sample, the mass spectrometer is configured to perform the steps associated with conducting all the SRM transitions assigned to one of the groups—either the "fast fragmentation" group or the "slow fragmentation" group—that were defined in step 601. If the mass spectrometer system comprises two collision cells, then, in step 602, a first one of the collision cells is rendered "active" and the other one of the collision cells is rendered "inactive". If the mass spectrometer system comprises a single partitioned collision cell, then a first portion of the collision cell is rendered "active" and the other portion of the collision cell is rendered "inactive" in step 602. The "active" collision cell or collision cell portion the cell or portion in which controlled ion fragmentation occurs. The "inactive" collision cell or collision cell portion is employed as a pass-through cell, i.e., as a simple ion guide. According to this method, one of the collision cells or cell portions is employed for performing the fragmentation steps associated with all of the "fast fragmentation" SRMs and the other one of the collision cells or cell portions is employed for performing the fragmentation steps associated with all of the "slow fragmentation" SRMs. Therefore, the choice of cell or cell portion that is rendered "active" in this step depends on which group of transitions are to be performed in the subsequent step 604.

Rendering a cell or cell portion as "active" will generally include introducing a collision gas into the cell or cell portion and may also include configuring electrodes so as to apply a drag field or axial field within said collision cell or cell portion. Rendering a cell or cell portion as "active" may also include configuring ion lenses that are upstream (along the ion pathway) from the cell so as to introduce ions into the cell or cell portion with an initial kinetic energy. Rendering a cell or cell portion as "inactive" will generally be a series of steps that are opposite to those required to render the cell as "active". For example, a previously introduced collision gas must be vented out of a cell or cell portion as part of the process of rendering it as "inactive".

In step 604 of the method 600 (FIG. 7), a first mass spectrometric analysis of the sample is conducted. During this step, the mass spectrometer performs all of the steps associated with conducting all of the SRM transitions assigned to one of the groups—either the "fast fragmentation" group or the "slow fragmentation" group. These steps include, for each SRM transition, isolating the appropriate precursor ion, fragmenting the isolated precursor ion in the active (first) collision cell or cell portion while employing the other collision cell or cell portion as a pass-through ion guide, transferring the product ions to a mass analyzer and conducting a search for the appropriate product ion using the mass analyzer. These steps are repeated for each SRM transition in the group (as defined in step 601) being analyzed. The mass spectrometric analysis will generally include additional common operations, such as supplying a portion of the sample to the mass spectrometer system, and ionizing the sample or sample portion to generate the precursor ions. If the sample is provided to the mass spectrometer as a series of chromatographically separated fractions, such as by liquid chromatography or gas chromatography, etc., then the step 604 may include performing the chromatographic separation using a first portion of the sample.

In step 606, the system is reconfigured so that the second collision cell or collision cell portion is rendered active and the previously active first collision cell is rendered inactive. This step includes venting of the collision gas from the first collision cell or cell portion and supplying collision gas to the second collision cell or cell portion. Then, during subsequent step 608, a second mass spectrometric analysis of the sample is conducted. During this step, the mass spectrometer performs all of the steps associated with conducting all of the SRM transitions assigned to the remaining group of transitions. These steps include fragmenting isolated precursor ions in the active (second) collision cell or cell portion while employing the first collision cell or cell portion as a pass-through ion guide. If the sample is provided to the mass spectrometer as a series of chromatographically separated fractions, then the step 608 may include performing the chromatographic separation a second time using a second portion of the sample. In a variation of the method 600, the sample that is analyzed in step 608 is different from the sample that is analyzed in step 604.

If the mass spectrometer employs a partitioned collision cell such as collision cell 252 shown in FIG. 4A, then the method 600 may be extended to include more than just two groups of SRM transitions. For example, the step 601 may be modified such that the SRM transitions of interest are divided into three groups (or any number of groups) based on fragmentation speed. The three groups may be defined as a "fast fragmentation" group, an "intermediate-speed fragmentation" group and a "slow fragmentation" group. For example, the three groups may be defined relative to a first pre-determined number of microseconds and a second pre-determined number of microseconds required for fragmentation.

Because the portion of the collision cell 252 that may be rendered as "active" is variable, three different such portions may of the collision cell 252 may be defined—each portion corresponding to and employed for the fragmentation of a respective one of the divided SRM groups. For example, only the rightmost chamber 240 of fragmentation cell 252 may be employed for fragmentation of the "fast fragmentation" group of SRM transitions by supplying collision gas to only this rightmost chamber 240 while maintaining the three leftmost chambers 240 under high vacuum. Similarly, only the rightmost two chambers may be employed for fragmenting the "intermediate-speed fragmentation" group and all four chambers may be employed for fragmenting the "slow fragmentation" group.

The flow chart shown in FIG. 7 may be readily conceptually modified so as to correspond to the analysis of the "fast fragmentation", "intermediate-speed fragmentation" and "slow fragmentation" groups of SRM transitions discussed above by adding another configuration step followed by another mass spectrometric analysis step after step 608. More generally, the flow chart can be conceptually modified so as to accommodate analyses comprising any number, N, of groups of SRM transitions by considering the configuration and analysis steps to be iterated N times, with one iteration per SRM group.

Figure 17:
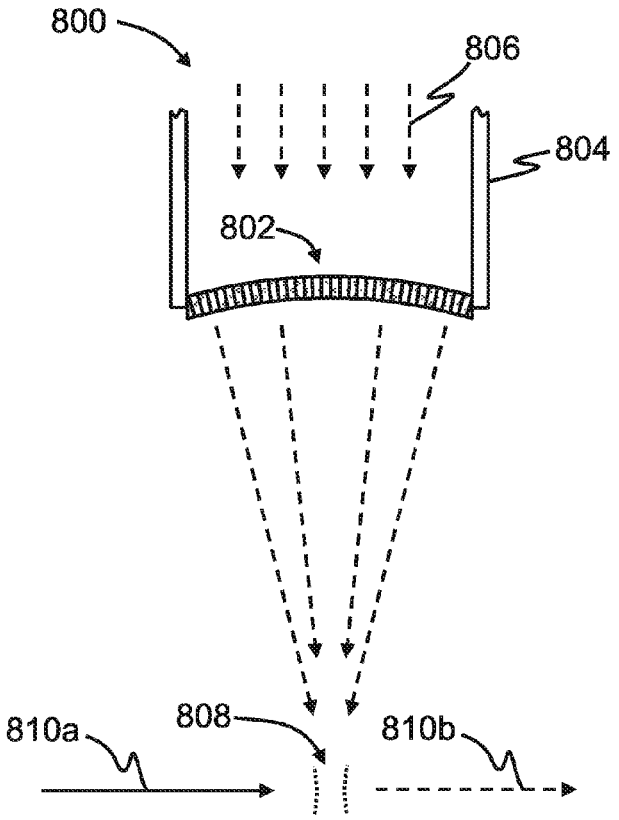
FIG. 17 (Prior Art)
FIG. 17 is a schematic depiction of a focused gas flow employed in lieu of a short collision cell, the focused gas flow generated by passing a flow of the gas through a curved multichannel plate apparatus.

FIG. 17 depicts a portion of another system embodiment does not comprise a casing or housing capable of enclosing a pressurized collision. Instead, the known apparatus 800 comprises a curved and perforated plate 802 that is fluidically coupled to a gas inlet tube 804 at its convex side. As a result of the curvature of the perforated plate, a flow of gas 806 supplied by the gas inlet tube encounters the perforations oriented in a fashion such that each perforation diverts a respective portion of the gas flow towards a gas focal position 808 that is disposed along the pathway 810*a* of a beam of ions comprising precursor ions.

In operation, the curved and perforated plate 802 (FIG. 17) functions as a "gas lens" that focuses a flow of gas to a small focal region of localized high gas pressure. The restriction of the gas to a small focal position 808 along the ion beam path creates a localized region of high pressure within which the probability of ion-molecule collisions is high such that fragmentation occurs in a short time duration (i.e., less than 100 μsec and, preferably, less than 100 μsec). Upon emerging from the focal region, a precursor-containing ions 810*a* is converted to fragment-containing beam of ions 810*b*. The beams of ions 810*a*, 810*b* are urged to flow along the beam direction, as indicated by arrows at the bottom of FIG. 17, by conventional or standard ion optics components (not illustrated). Thus, additional means for providing an axial field is not required as part of the simple apparatus 800. Although the gas pressure is relatively high at the focal position 808, the overall flow rate of gas supplied from the gas inlet tube 804 is sufficiently small that the gas may be readily purged from a mass spectrometer high vacuum chamber by an existing evacuation system without significant vacuum degradation.

In many embodiments, the curved and perforated plate 802 may comprise an originally-flat portion of a micro-channel plate, as is often used in image intensifiers and night-vision apparatus (see, for example, U.S. Pat. No. 6,259,088). The curvature of the originally-flat portion may be induced by application of heat. The micro-channels may be generated by chemical etching after the deformation.

CONCLUSION

The discussion included in this application is intended to serve as a basic description. Although the present invention has been described in accordance with the various embodiments shown and described, one of ordinary skill in the art will readily recognize that there could be variations to the embodiments and those variations would be within the scope of the present invention. For example, collision cell components of apparatus embodiments in accordance with the present teachings may employ any of the configurations shown in FIGS. 1D-1E, FIGS. 2A-2B, FIGS. 8A-8D, FIGS. 9-12, FIGS. 13A-B or FIGS. 14-15 and discussed in respectively associated paragraphs above for purposes of generating a drag field or axial field within the collision cell. In the case of axial field generating components, configurations or systems that employ a resistive coating or a resistive member (the coating or member provided either as part or all of a quadrupole rod or part or all of an auxiliary rod) as all or a portion of the mechanism for generating the axial field, the resistive material may be formed of any one of a number of materials (e.g., without limitation, doped glasses, cermets, polymers, metallic oxides, doped glasses, metal films, ferrite compounds, carbon resistive inks, etc.) having electrically resistive properties. A resistive ink comprising ruthenium oxide is contemplated as a suitable resistive coating material that may be applied to rods or tubes described herein. It is also possible to generate a resistive coating on a glass surface by, for example, chemical reactions (U.S. Pat. No. 7,081,618).

Where reference is made in the above discussion to "quadrupole" components of collision cell components, it is to be understood that any conventional multipole rod configuration, such as a hexapole, octopole, dodecapole, etc. multipole rod configuration may be substituted for the quadrupole configuration. Further, although many of the accompanying drawings illustrate rods (either multipole rods or auxiliary rods) having circular cross sections, rods having any cross sectional shape, such as square, rectangular, oval, polygonal, etc. may alternatively be employed in various embodiments in accordance with the present teachings.

The reader should be aware that the specific discussion may not explicitly describe all embodiments possible; many alternatives are implicit. Accordingly, many modifications may be made by one of ordinary skill in the art without departing from the scope of the invention. Neither the description nor the terminology is intended to limit the scope of the invention—the invention is defined only by the claims. Any patents, patent publications or other publications mentioned herein are hereby incorporated by reference in their respective entireties.

What is claimed is:

1. A method for operating a mass spectrometer so as to detect a presence of or a quantity of each of one or more analytes of a sample, each analyte associated with a respective pre-determined selected-reaction-monitoring (SRM) transition, the method comprising:

(a) for each of the one or more pre-determined SRM transitions, determining a time duration required for a fragmentation reaction corresponding to the respective SRM transition to proceed to a certain threshold percentage of completion;

(b) ionizing the sample in an ionization source of the mass spectrometer so as to produce one or more populations of first-generation ions; and (c) for each of the one or more pre-determined SRM transitions, performing the steps of:

(c1) isolating a sub-population of a one of the one or more populations of first-generation ions corresponding to a precursor-ion mass-to-charge (m/z) ratio associated with the respective SRM transition;

(c2) fragmenting the respective isolated sub-population of ions in a one of two fragmentation cells of the mass spectrometer so as to produce a respective population of fragment ions; and (c3) analyzing, with a mass analyzer of the mass spectrometer, for the presence or quantity, among the respective fragment ions, of ions corresponding to a product-ion in/z ratio associated with the respective SRM transition, wherein, for each pre-determined SRM transition, the fragmentation cell that is used for fragmenting the isolated sub-population of ions corresponding to the respective precursor-ion in/z ratio is determined from the time duration determined for the respective pre-determined SRM transition.

2. A method as recited in claim 1, wherein, for each of a subset of the pre-determined SRM transitions for which the determined time duration is less than or equal to a threshold time duration, the step (c2) of fragmenting the respective isolated sub-population of ions in a one of two fragmentation cells includes transferring said respective isolated sub-population of ions through the other one of the two fragmentation cells.

3. A method as recited in claim 2, wherein the threshold time duration is 10 milliseconds.

4. A method as recited in claim 2, wherein the threshold time duration is 100 microseconds.

5. A method as recited in claim 1, wherein, for a subset of the pre-determined SRM transitions for which the determined time duration is greater than a threshold time duration, the analyzing step (c3) includes transferring the respective fragment ions through a one of the two fragmentation cells other than the fragmentation cell within which the respective fragment ions were produced in the fragmenting step (c2).

6. A method as recited in claim 5, wherein the threshold time duration is 10 milliseconds.

7. A method as recited in claim 5, wherein the threshold time duration is 100 microseconds.

8. A method as recited in claim 1, wherein for each of a subset of the pre-determined SRM transitions for which the determined time duration is less than or equal to a threshold time duration, the step (c2) of fragmenting the respective isolated sub-population of ions in a one of two fragmentation cells comprises fragmenting the respective isolated sub-population of ions in a one of the two fragmentation cells comprising a length that is shorter than a length of the other fragmentation cell.

9. A method as recited in claim 1, wherein, for a subset of the pre-determined SRM transitions for which the determined time duration is greater than a threshold time duration, the step (c2) of fragmenting the respective isolated sub-population of ions in a one of two fragmentation cells comprises fragmenting the respective isolated sub-population of ions in a one of the two fragmentation cells comprising a length that is greater than a length of the other fragmentation cell.

10. A method for operating a mass spectrometer so as to detect a presence of or a quantity of each of one or more analytes of a sample, each analyte associated with a respective pre-determined selected-reaction-monitoring (SRM) transition, the method comprising:

(a) for each of the one or more pre-determined SRM transitions, determining a time duration required for a fragmentation step corresponding to the pre-determined SRM transition to proceed to a certain threshold percentage of completion;

(b) ionizing the sample in an ionization source of the mass spectrometer so as to produce one or more populations of first-generation ions; and (c) for each of the one or more pre-determined SRM transitions, performing the steps of:

(c1) isolating a sub-population of the one or more populations of first-generation ions corresponding to a precursor-ion mass-to-charge (m/z) ratio associated with the respective SRM transition;

(c2) fragmenting the respective isolated sub-population of ions in a one of two portions of a partitioned fragmentation cell of the mass spectrometer so as to produce a respective population of fragment ions; and (c3) analyzing, with a mass analyzer of the mass spectrometer, for the presence or quantity, among the respective fragment ions, of ions corresponding to a product-ion ink ratio associated with the respective SRM transition, wherein, for each pre-determined SRM transition, the portion of the partitioned fragmentation cell that is used for fragmenting the isolated sub-population of ions corresponding to the respective precursor-ion in/z ratio is determined from the time duration determined for the respective pre-determined SRM transition.

11. A method as recited in claim 10, wherein, for each of a subset of the pre-determined SRM transitions for which the determined time duration is less than or equal to a threshold time duration, the step (c2), of fragmenting the respective isolated sub-population of ions in a one of the two portions of the partitioned fragmentation cell includes transferring said respective isolated sub-population of ions through the other portion of the partitioned fragmentation cell.

12. A method as recited in claim 11, wherein the threshold time duration is 10 milliseconds.

13. A method as recited in claim 11, wherein the threshold time duration is 100 microseconds.

14. A method as recited in claim 10, wherein, for a subset of the pre-determined SRM transitions for which the determined time duration is greater than a threshold time duration, the analyzing step (c3) includes transferring the respective fragment ions through a one of the two portions of the partitioned fragmentation cell other than the portion of the partitioned fragmentation cell within which the respective fragment ions were produced.

15. A method as recited in claim 14, wherein the threshold time duration is 10 milliseconds.

16. A method as recited in claim 11, wherein the threshold time duration is 100 microseconds.

17. A method as recited in claim 10, wherein a pressure of a collision gas within a first one of the two portions of the partitioned fragmentation cell and a pressure of the collision gas within a second one of the two portions of the partitioned fragmentation cell are controlled independently of one another.

18. A method as recited in claim 1, wherein the step (c2) of fragmenting the respective isolated sub-population of ions in a one of two fragmentation cells so as to produce a respective population of fragment ions includes applying an axial field along an axis of the one of the two fragmentation cells.

19. A method as recited in claim 10, wherein the step (c2) of fragmenting the respective isolated sub-population of ions in a one of the two portions of the partitioned fragmentation cell so as to produce a respective population of fragment ions includes applying an axial field along an axis of the one of the two portions of the partitioned fragmentation cell.

* * * * *